US006261749B1

(12) United States Patent
Asami

(10) Patent No.: US 6,261,749 B1
(45) Date of Patent: Jul. 17, 2001

(54) SILVER HALIDE COLOR PHOTOGRAPHIC MATERIAL AND METHOD OF FORMING COLOR IMAGES USING THE SAME

(75) Inventor: Masahiro Asami, Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/376,298

(22) Filed: Aug. 18, 1999

(30) Foreign Application Priority Data

Aug. 20, 1998 (JP) ..... 10-234354

(51) Int. Cl.[7] ..... G03C 1/46

(52) U.S. Cl. ..... 430/505; 430/561

(58) Field of Search ..... 430/505, 561

(56) References Cited

U.S. PATENT DOCUMENTS

| | | | | |
|---|---|---|---|---|
| 5,091,293 | | 2/1992 | Nozawa et al. . | |
| 5,716,772 | * | 2/1998 | Taguchi | 430/543 |
| 5,851,745 | * | 12/1998 | Takeguchi | 430/566 |
| 6,021,277 | * | 2/2000 | Sowinski et al. | 396/6 |

* cited by examiner

*Primary Examiner*—Hoa Van Le
*Assistant Examiner*—Amanda C. Walke
(74) *Attorney, Agent, or Firm*—Birch, Stewart, Kolasch & Birch, LLP

(57) ABSTRACT

Disclosed is a ultrahigh speed silver halide color photographic material for picture-taking use, which comprises a support coated with at least three light-sensitive layers comprising blue-sensitive, green-sensitive and red-sensitive silver halide emulsions respectively: with the photographic material having a characteristic speed of at least 800 and the total silver coverage of at most 7.0 g/m$^2$, and satisfying the following relation between the total silver coverage (X) and the characteristic speed (Y); $(X)/(Y)^{1/2} \leqq 0.185$, thereby ensuring excellent granularity and storage stability.

7 Claims, No Drawings

SILVER HALIDE COLOR PHOTOGRAPHIC MATERIAL AND METHOD OF FORMING COLOR IMAGES USING THE SAME

FIELD OF THE INVENTION

The present invention relates to a silver halide color photographic material which enables high-speed recording of images and has excellent storage stability, and further to a method of forming color images simply and rapidly by the use of the aforesaid photographic material.

BACKGROUND OF THE INVENTION

Silver halide-utilized photographic materials, namely silver salt photographic systems, have undergone accelerative development in recent years; as a result, color images of high quality can be got with ease at the present time. Owing to the highly advanced recent developments in generally used color photographic processes and the spread of not only the so-called color labo, or photofinishing laboratories for highly efficient mass-production of color prints, as large-scale local bases but also the so-called mini-labo, or small-sized simplified print processors installed in stores, everybody can be easily amused with color photographs.

Further, the APS system embodying a new concept has been lately introduced into the market. In such a system, a magnetic substance-applied support is used in color negative films and diverse information can be recorded thereon as magnetic record. That system proposes new ways of enjoying photographs. Therein, for instance, changes in print size can be introduced by facilitating the handling of films and recording the information at the time of photographing. In addition, tools for editing and processing the image information read from processed negative films by means of a simple scanner have been proposed. By utilizing such a method, high-quality image information from silver salt photographs can be readily converted into digital information, and so a wide range of applications going over the conventional ways of enjoying photographs are being popularized.

On the other hand, the so-called digital still cameras using CCD as image pickup elements are making rapid progress in their performance. With respect to the cameras intended for amateur use, it was these several years ago that the cameras loaded with CCD elements having more than several millions of pixels were beginning to appear on the market. Unlike general color photographic systems, the digital still cameras require no processes for developing exposed films, but they can directly provide digitized image information. Therefore, the taken images can be checked at once on a liquid crystal monitor, and the digital information obtained can be easily utilized for various purposes. It is also possible to transfer such image information to a printer, thereby making prints with ease. Further, the image information can be processed variously with a personal computer and enables easy transfer via internet. The latest increase in density of CCD and the recent advance in performance of mass digital data-handling apparatus have come to ensure the image quality worth viewing as photographs for the images printed; as a result, discussion has opened up over the probability of substitution of those digital still cameras for conventional cameras used in photography.

Under these circumstances, it is desired to pursue higher photographic speed and higher latitude at silver halide photosensitive materials from the viewpoint of further development of the silver salt photographic system in opposition to the digital still camera system. Although remarkable improvements have been made in CCD characteristics as the image pickup element of a digital still camera, there is a limit to the photographic speed which can be heightened, increasing the number of pixels in the element of a limited size. Further, it is difficult in principle to ensure high latitude under price and convenience restrictions imposed on the camera system. Therefore, if the silver halide photosensitive materials can achieve higher photographic speed and higher latitude than ever and can be loaded in inexpensively and handy goods, such as lens-attached films, an attractive system can be offered to users.

The photographic speeds of silver halide photosensitive materials have been increased as times have passed, and the color negative films prevalent on the current market have the photographic speed of ISO 400. However, even such a speed is not enough for enjoyment of taking photographs at any time and at any place without auxiliary means such as a strong strobe light. The commercial ultrahigh-speed films having the photographic speed of ISO 1600 or ISO 3200 are on the market today. These films can advance the limits of photography, indeed, but further increase in photographic speed is to be desired. However, with the further increase in photographic speed, the photographic materials using silver halide grains as a photosensitive element come to bear various problems.

For the increase in photographic speed of a silver halide photosensitive material, it is effective to increase the grain size of silver halide grains used in the photosensitive material. In general, however, the use of coarse grains often deteriorates the granularity of the image formed, and thereby the image quality is marred. As an effective means to improve this situation, it is usable to increase the number of silver halide grains present in a unit area of a photosensitive material. In addition, increasing the number of silver halide grains per unit area is also effective for efficiently capturing rays of light incident on the film. Therefore, there is a general tendency for color negative films available at stores to have a greater rise in silver coverage with the increase in their photographic speed. In a case where high speed silver halide grains are incorporated at a high silver coverage in a photosensitive material, however, it becomes impossible to disregard the effect of natural radiant rays, and so the products suffer a marked deterioration in photographic properties, including fog and granularity, upon storage.

As a means to solve such a problem, the art of designing a photosensitive material to have a reduced coverage of silver halides as a constituent thereof while ensuring a high photographic speed therein is disclosed in U.S. Pat. No. 5,091,293.

The aim of the art disclosed therein is to improve the drawbacks involved in reduction of silver coverage, e.g., decrease in photographic speed and deterioration in granularity, by the use of a core/shell emulsion having a high iodide content on the inside, the use of two-equivalent couplers, and the use of particular DIR compounds or silver halide grains having an aspect ratio of at least 5. However, such an art is insufficient to compensate for the lowering of sensitivity and the deterioration in granularity caused by a reduction of silver coverage. Therefore, it has been desired to further develop the arts of achieving an ultrahigh-speed of at least ISO 1000 while retaining excellent image quality.

On the other hand, it is also an urgent problem to further simplify and speed up photographic processing steps, because the weak point of silver halide photosensitive materials consists in the need to undergo photographic processing. A strong point of digital still cameras lies in requiring no liquid development steps. By contrast, the photographic processing of silver halide photographic materials requires exclusive processing equipment and careful management, and so can be performed at limited bases alone. A first reason therefor is that accurate control of compositions and temperatures is necessary for the processing baths to effect color development, bleaching and fixation, and technical information and skilled operations are required therefor. A second reason therefor is that, as the processing baths contain materials subject to ecological regulations against the discharge of their wastes, such as color developing agents and chelate compounds of iron as bleaching agents, exclusive facilities for installing developing apparatus therein are required in many cases. A third reason therefor is that, although the recent technological development has enabled a reduction in processing time, the photographic processing still costs time and is at a level insufficient to meet the demand for rapid reproduction of recorded images.

In view of these points, a number of improved arts have been proposed. For instance, *IS & T's 48th Annual conference Proceedings*, page 180, discloses the system wherein the bleach-fix bath, which is essential to conventional color photographic processing, is rendered unnecessary by transferring the dyes produced by development into a mordant layer and then peeling away the mordant layer. However, the art proposed therein still requires development with a processing bath containing a color developing agent, so that it cannot be said that such an art has resolved the environmental pollution problem.

With respect to the system which requires no processing solution containing a color developing agent, the pictrography system is proposed by Fuji Photo Film Co., Ltd. Although this system has an ecological advantage of being free of the aforesaid processing bath, it is a system for providing printed images by the transfer of diffusive dyes produced by development reaction into an image-receiving material. As far as it is unreformed, therefore, such a system is unsuitable for processing ultrahigh-speed picture-taking photosensitive materials as a subject of the present invention.

SUMMARY OF THE INVENTION

As is apparent from the above description, a first object of the present invention is to provide a picture-taking photosensitive material which has not only an ultrahigh speed but also excellent stability upon storage before exposure and ensures high quality, including satisfactory graininess, in the images.

A second object of the present invention is to provide a picture-taking photosensitive material which enables simple, rapid formation of high-quality images with a reduced load on the surroundings as it bears high-speed, high-quality characteristics.

The aforementioned objects of the present invention are attained effectively with the embodiments (1) to (8) described below.

(1) A silver halide color photographic material which comprises a support coated with at least three light-sensitive layers comprising blue-sensitive, green-sensitive and red-sensitive silver halide emulsions respectively; said photographic material having a characteristic speed of at least 800 and the total silver coverage of at most 7.0 g/m$^2$, and satisfying the following relation between the total silver coverage (X) and the characteristic speed (Y):

$$(X)/(Y)^{1/2} \leq 0.185$$

(2) A silver halide color photographic material as described in the foregoing embodiment (1), with the photographic material having suitability for high-temperature development processing carried out at about 38° C. or above.

(3) A silver halide color photographic material as described in the foregoing embodiment (2), wherein the characteristic speed is at least 1,000, the total silver coverage is at most 6.5 g/m$^2$ and the development processing is carried out at 70° C. or above.

(4) A silver halide color photographic material as described in the foregoing embodiment (1), (2) or (3), further comprising a developing agent and compounds forming dyes by coupling reaction with the oxidation product of the developing agent.

(5) A silver halide color photographic material as described in the foregoing embodiment (1), (2), (3) or (4), wherein at least one of the light-sensitive silver halide emulsions comprises silver halide grains at least 50%, on a projected area basis, of which are tabular grains having a thickness of 0.2 $\mu$m or below and an aspect ratio of from 2 to 80, wherein the aspect ratio is the value obtained by dividing the projected grain area diameter by the grain thickness.

(6) A silver halide color photographic material as described in the fore going embodiment (1), (2), (3), (4) or (5), wherein images are formed when the photographic material is exposed and then developed by superimposing thereon a processing material comprising a support coated with a base and/or base precursor-containing processing layer in a condition that the photographic material and the processing material face each other and water lies between them in an amount ranging from one-tenth to equivalent with the amount required for achieving the maximum of swelling in all the coated layers of those materials and then applying heat to those materials.

(7) A silver halide color photographic material as described in the foregoing embodiment (4), (5) or (6), wherein the developing agent is a compound represented by the following formula (I), (II), (III) or (IV):

Formula (I)

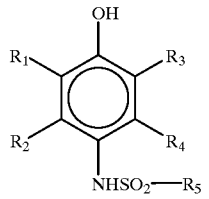

Formula (II)

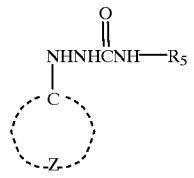

Formula (III)

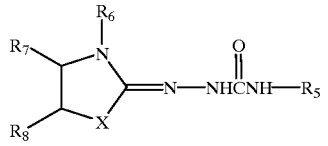

-continued

Formula (IV)

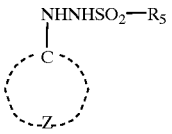

wherein $R_1$, $R_2$, $R_3$ and $R_4$ each represent a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents an alkyl group, an aryl group or a heterocyclic group; Z represents atoms completing an aromatic hydrocarbon or heterocyclic ring, wherein when the ring completed is a substituted benzene ring the total Hammett's σ values of substituent groups on the benzene ring is at least one; $R_6$ represents an alkyl group; X represents an oxygen atom, a sulfur atom, a selenium atom or a tertiary nitrogen atom to which an alkyl or aryl group is attached; and $R_7$ and $R_8$ each represent a hydrogen atom or a substituent group, or $R_7$ and $R_8$ combine with each other to form a double bond or a ring; provided that at least one ballast group having at least 8 carbon atoms is present in each of the formulae (I) to (IV) to confer solubility in oils upon the compound.

(8) A method of forming color images, comprising the following steps sequentially;

a step of exposing imagewise a silver halide photographic material according to the foregoing embodiment (1), (2), (3), (4), (5), (6) or (7), a step of superimposing the photographic material upon a processing material which comprises a support coated with a base and/or base precursor-containing processing layer in a condition that the processing material and the photographic material face each other and water lies between them in an amount ranging from one-tenth to equivalent with the amount required for achieving the maximum of swelling in all the coated layers of those materials, and a step of heating the superimposed materials for a period of from 5 to 60 seconds at a temperature of from 60° C. to 100° C.

DETAILED DESCRIPTION OF THE INVENTION

The present photographic material is required to have a characteristic speed of at least 800 and the total silver coverage of at most 7.0 g/m$^2$ and to satisfy the following relation between the total silver coverage (X) and the characteristic speed (Y):

$$(X)/(Y)^{1/2} \leqq 0.185$$

The term "the total silver coverage" as used herein means the sum of coverages of silver halide and colloidal silver contained in all the layers constituting the present photographic material, and the value thereof is expressed on a metal silver basis.

The term "characteristic speed" as used herein refers to the ISO speed determined following the procedure as described in International Standards ISO 5800 or Japanese industrial standards JIS K 7614-1981 corresponding thereto. The determination method of the present characteristic speed is described below in detail.

All the experiments for determining the speed are carried out at a temperature of 20±5° C. and a relative humidity of 60±10%. Film samples used for experiments are allowed to stand for at least one hour under the foregoing circumstances prior to the experiments.

Each of film samples to be examined for speed is subjected to 1/100-second exposure via an optical wedge using as light source the daylight for speed measurement, or the combination of photographic daylight (color temperature: about 5,500° K) with the relative spectral transmittivity of ISO standard camera lens, and then to color development. After the color development, the ISO status M diffusion transmission densities of each film sample are measured, thereby obtaining a characteristic curve. The conditions for the foregoing color development may be the processing conditions adopted in the photographic system to be used when the present invention is practiced.

The characteristic curve is obtained by plotting the ISO status M diffusion transmission density of blue (B), green (G) or red (R) as ordinate and the common logarithm of the exposure H as abscissa. The standard point to determine the speed is 0.15+ the minimum density on the characteristic curve for each of the colors B, G and R. These three points are symbolized by B, G and R respectively, and the exposure values corresponding thereto, $H_B$ (lux·sec), $H_G$ (lux·sec) and $H_R$ (lux·sec), are determined respectively. The characteristic speed S can be calculated from the greatest exposure value $H_S$ among those three exposure values and the standard exposure value $H_G$ of the green-sensitive layer by the use of the following equation:

$$S=\sqrt{2}/(H_G \times H_S)$$

In the present invention, the characteristic speed thus determined is required to be at least 800. For indoor photography under a feeble strobe light, it is desirable that the characteristic speed be at least 1,000, preferably at least 1,250.

Moreover, the foregoing relation is required to hold between the characteristic speed and the total silver coverage.

For satisfying the aforementioned relation while keeping the speed at the intended level, it is enough to decrease the coverage of silver halide in the photographic material. The present photographic material is required to have the total silver coverage of no higher than 7.0 g/m$^2$. By designing a photographic material so as to have such a low silver coverage, the photographic material can undergo remarkable improvements in fog generation during storage before exposure and graininess deterioration even when it is endowed with an ultrahigh speed aimed at by the present invention, or not lower than 800 expressed in the characteristic speed. In order to fully achieve the effects of the present invention, it is desirable to control the total silver coverage to 6.5 g/m$^2$ or below, preferably 6.0 g/m$^2$ or below, particularly preferably 5.5 g/m$^2$ or below.

As mentioned above, it is difficult to surmount the lowering of speed and the deterioration in graininess is difficult by a simple reduction in the quantity of silver halide grains comprised in a silver halide photographic material so far as the hitherto known arts are adopted. This problem is particularly serious in the case where the total silver coverage of a photographic material is reduced to 7.0 g/m$^2$ or below with the intention of achieving excellent storage stability as in the present invention.

As a result of our intensive study on the foregoing problem to be surmounted, it has been found that an ultra-high speed of no lower than 800 expressed in characteristic speed can be conferred upon a photographic material by raising the development temperature of the photographic material up to 50° C. or above (preferably 60° C. or above, more preferably 70° C. or above) or by combining the application of high-temperature development, wherein the development temperature of no lower than about 38° C. is chosen, with the use of thin tabular grains having a thickness of 0.2 μm or below as silver halide grains, and both improvement of graininess and control of fog upon storage before exposure can be realized simultaneously by designing so that the ratio of the total silver coverage to (characteristic speed)$^{1/2}$ is not higher than 0.185.

In a case where the developer containing an aromatic primary amine developing agent is used, as in conventional development of silver halide color photographic materials, a rise in developer temperature causes an increase in the speed of deteriorative reactions, such as aerial oxidation of a developing agent, and other troubles, such as the vaporization of water from the developer. Therefore, there are limits to the high temperature development. For fully achieving the effects of the present invention, it is desirable to incorporate a developing agent into the present photographic material, to prepare a processing material comprising a support coated with a base and/or base precursor-containing processing layer, and to subject the photographic material to high-temperature development after exposure. The high-temperature development therein is effected by bringing the processing material into face-to-face contact with the photographic material in a condition that water is spread between these two materials in an amount ranging from one-tenth to equivalent with the amount required for achieving the maximum of swelling in all the coated layers of those materials, and then by heating them.

Further, it is desirable for a silver halide emulsion used in the present photographic material to comprise tabular silver halide grains having a thickness of 0.2 μm or below and an aspect ratio of 2 to 80 in a proportion of at least 50%, on a projected area basis, to the total silver halide grains in the silver halide emulsion. Therein, the term aspect ratio refers to the value obtained by dividing a projected grain diameter by a grain thickness. The use of such a silver halide emulsion can further increase the effect of the present invention, or the effect of the heightened development temperature upon achievement of high speed and good graininess under a reduced silver coverage condition.

The aspect ratio is preferably at least 5, more preferably at least 8, and most preferably at least 12. In the case of using relatively fine grains having a size of about 0.5 μm or below, expressed in the diameter of a sphere having the same volume as each grain, it is desirable for the grains to have a tabularity of at least 25, wherein the term tabularity refers to the value obtained by dividing the aspect ratio by the grain thickness.

The arts of utilizing tabular grains having such a high aspect ratio and their characteristics are disclosed in, e.g., U.S. Pat. Nos. 4,433,048, 4,434,226 and 4,439,520. Further, the arts of tabular grains having such an ultrahigh aspect ratio that the grain thickness is not thicker than 0.07 μm are disclosed in, e.g., U.S. Pat. Nos. 5,494,789, 5,503,970, 5,503,971 and 5,536,632, and European Patents 0,699,945, 0,699,950, 0,699,948, 0,699,944, 0,701,165 and 0,699,946. In preparing tabular grains having a small thickness and a high aspect ratio, it is important to control the binder concentration, the temperature, the pH, the species of excess halogen ions and their concentration, and feeding speeds of reactant solutions at the time of nucleation. In order that the tabular nuclei formed be made to grow selectively in the circumferential direction of the tablet, but not in the thickness direction, it is important to control the addition speeds of reactant solutions for grain growth, and at the same time to select the most suitable binder for the grain formation and growth. As such a binder, gelatin having a low methionine content and gelatin whose amino groups are modified with phthalic acid, trimellitic acid or pyromellitic acid are used to advantage.

The silver halide used in the present invention may be any of silver iodobromide, silver chloroiodobromide, silver bromide, silver chlorobromide, silver iodochloride and silver chloride. The halide composition is selected depending on the characteristics to be conferred upon light-sensitive silver halide.

In the present invention, silver halide grains of various shapes can be employed, but it is desirable that the distribution of sizes among them be monodisperse. The silver halide emulsions used to advantage in the present invention are those having a variation coefficient of 40% or below, preferably 30% or below, especially preferably 20% or below, with respect to the grain size distribution.

In a case of using tabular silver halide grains, it is desirable that the variation coefficient be small with respect to the grain thickness distribution as well. More specifically, the desirable tabular grains have a variation coefficient of 40% or below, preferably 30% or below, particularly preferably 20% or below, with respect to the grain thickness distribution as well.

Besides devising grain shapes as mentioned above, the silver halide grains are prepared so as to have various internal structures. According to the preparation method in common use, the grains have a structure constituted of two or more layers differing in halide composition. With respect to the silver iodobromide grains used for picture-taking materials, it is desirable that the layers be designed so as to have different iodide contents. For instance, the control of developability is known to be attainable with the so-called core/shell grains of inner high iodide content type, or the grains in which the layer as a core has a high iodide content and the core is covered with a shell having a low iodide. Contrary to those grains, the core/shell grains of outer high iodide content type, wherein the core is covered with a shell having a high iodide content, are also known. This structure is effective in enhancing the grain shape stability when the tabular grains have a small thickness. Further, it is also known as the art of conferring high sensitivity upon grains to cover the core having a low iodide content with a first shell having a high iodide content and thereon deposit a second shell having a low iodide content. In the silver halide grains of such a type, the second shell deposited on the high iodide content phase (corresponding to the fringe part of tabular grains) forms dislocation lines arising from crystal asymmetry to contribute to the attainment of high sensitivity. The suitable method for the deposition of high iodide content phase is, e.g., the method of adding a solution of water-soluble iodide, such as potassium iodide, independently or simultaneously with a solution of water-soluble silver salt, such as silver nitrate, the method of introducing fine grains of silver iodide into the grain formation system, or the method of adding a compound capable of releasing iodide ion upon reaction with an alkali or nucleophilic agent (e.g., sodium p-iodoacetamidobenzene-sulfonate).

The grains used in the present invention can be grains prepared by depositing epitaxial projections on the surface of any type of the host grains mentioned above.

The present silver halide grains are preferably doped with polyvalent metal ions, such as transition metal ions. Although these polyvalent metal ions can be introduced in the halide or nitrate form during the grain formation, it is desirable for them to be introduced in the form of metal complex containing a polyvalent metal ion as the central metal (such as the halogeno, amine, cyano or nitrosil complex form).

The metal complexes used to advantage in the present invention are complexes which are each formed by coordination of ligands capable of causing a great splitting in the d-orbital of the spectrochemical series, such as cyanide ion, to a metal ion belonging to the first, second or third transition series. It is desirable for such a complex to have a coordination form that the coordination number is six, the six ligands form an octahedral structure and at least four of the six ligands are cyano ligands.

Suitable examples of a central transition metal include iron, cobalt, ruthenium, rhenium, osmium and iridium.

In cases where not all the six ligands are cyano ligands, the remainder ligands can be selected from inorganic ligands such as halide ion (e.g., fluoride ion, chloride ion, bromide ion), SCN, NCS and $H_2O$ ligands, or organic ligands such as pyridine, phenanthroline, imidazole and pyrazole ligands.

In addition to the foregoing metal complexes, it is also desirable in the present emulsions to use other metal complexes, such as a ruthenium, rhodium, palladium or iridium complex having halide ions or thiocyanate ions as ligands, a ruthenium complex having at least one nitrosil ligand, and a chromium complex having cyanide ions as ligands.

Besides the forgoing metal complexes, divalent anions of the so-called chalcogen elements, such as sulfur, selenium and tellurium, are also used to advantage for doping the present silver halide grains. These dopants are also effective in increasing the sensitivity and improving the dependency on the exposure condition.

The silver halide grains used in the present invention can be prepared basically according to known methods, namely the methods described in, e.g., P. Glafkides, *Chemie et Physique Photographique*, Paul Montel (1967), G. F. Dufin, *Photographic Emulsion Chemistry*, The Focal Press (1966), V. L. Zelikman, et al., *Making and Coating Photographic Emulsion*, The Focal Press (1964). More specifically, the emulsions can be prepared in various pH regions, e.g., using an acid, neutral or ammoniacal process. As for the way of feeding reactant solutions, including a solution of water-soluble silver salt and a solution of water-soluble halide, any of a single jet method, a double jet method and a combination thereof may be employed. Further, the so-called controlled double jet method, wherein the addition of reactant solutions is controlled so as to maintain the pAg value at the intended value during the reaction, can be employed to advantage. Furthermore, the method of keeping the pH value constant during the reaction may be employed as well. In forming grains, it is feasible to adopt the method of controlling the solubility of silver halide by changing the temperature, pH or pAg value of the reaction system, but silver halide solvents, such as thioethers, thioureas or thiocyanates, may be added to the reaction system. These cases are described in, e.g., JP-B-47-11386 (the term "JP-B" as used herein means an "examined Japanese patent publication") and JP-A-53-144319 (the term "JP-A" as used herein means an "unexamined published Japanese patent application").

The preparation of the present silver halide grains is generally effected by feeding a solution of water-soluble silver salt, such as silver nitrate, and a solution of water-soluble halide, such as alkali halide, into an aqueous solution of water-soluble binder, such as gelatin, under the controlled conditions. After the formation of silver halide grains, it is desirable to carry out the removal of excess water-soluble salts. The excess water-soluble salts can be removed using the noodle washing method which comprises gelling the gelatin solution containing silver halide grains, cutting into strips and washing out the water-soluble salts with cold water, or the flocculation method in which a flocculant, such as an inorganic salt containing a polyvalent anion (e.g., sodium sulfate), an anionic surfactant, an anionic polymer (e.g., sodium polystyrenesulfonate) or a gelatin derivative (e.g., an aliphatic acylated gelatin, an aromatic acylated gelatin, an aromatic carbamoylated gelatin), is added to cause the aggregation of gelatin, thereby removing the excess salts. Of these methods, the flocculation method is preferable because it enables rapid removal of excess salts.

In general, it is desirable that the silver halide emulsions used in the present invention be chemical sensitized using known sensitization methods alone or in various combinations. The chemical sensitization contributes to conferring high sensitivity, exposure condition stability and storage stability upon the silver halide grains prepared.

The chemical sensitization methods used to advantage is a chalcogen sensitization method using a sulfur, selenium or tellurium compound. Examples of a sensitizer usable herein include compounds capable of releasing a chalcogen element as recited above to form silver chalcogenide when added to a silver halide emulsion. The combined use of such sensitizers is desirable from the viewpoint of increasing the sensitivity and suppressing the fog.

In addition, it is also desirable to adopt the precious metal sensitization method using gold, platinum, iridium or the like. In particular, the gold sensitization method using chloroauric acid alone or in combination with thiocyanate ion, which can coordinate to gold, is advantageous due to its high sensitizing effect. Further high sensitivity can be obtained by the combined use of gold sensitization and chalcogen sensitization.

Another sensitization method used to advantage is the so-called reduction sensitization method wherein reduced silver nuclei are introduced by the use of a compound having moderate reducing power during the grain formation, thereby increasing the sensitivity. Further, the reduction sensitization method of adding an aromatic ring-containing alkinylamine compound at the time of chemical sensitization is favorably used.

In carrying out chemical sensitization, it is also desirable to control the reactivity therein by the addition of various compounds having adsorbability to silver halide grains. For the reactivity control, it is especially desirable to adopt the method of adding a nitrogen-containing heterocyclic compound, a mercapto compound or sensitizing dyes, such as cyanine and merocyanine dyes, prior to chalcogen sensitization and gold sensitization.

The appropriate reaction conditions for chemical sensitization depend on the desired purpose. Specifically, the temperature is from 30° C. to 95° C., preferably from 40° C. to 75° C.; the pH is from 5.0 to 11.0, preferably from 5.5 to 8.5; and the pAg is from 6.0 to 10.5, preferably from 6.5 to 9.8.

The arts of chemical sensitization are described in, e.g., JP-A-3-110555, JP-A-5-241267, JP-A-62-253159, JP-A-5-45833 and JP-A-62-40446. In the chemical sensitization step, it is desirable to form an epitaxial projection part on the grain surface.

The light-sensitive silver halide emulsions used in the present invention are desirably subjected to the so-called spectral sensitization to acquire sensitivities in the desired wavelength regions. In particular, sensitive layers having sensitivities to blue, green and red lights respectively are incorporated in a color photographic material for the purpose of reproducing colors faithful to an original. These color sensitivities are conferred by spectrally sensitizing silver halide with the so-called spectral sensitizing dyes.

Such sensitizing dyes include cyanine dyes, merocyanine dyes, complexcyaninedyes, complexmerocyaninedyes, holopolar dyes, hemicyanine dyes, styryl dyes and hemioxonol dyes. Examples of these dyes are disclosed in U.S. Pat. No. 4,617,257, JP-A-59-180550, JP-A-64-13546, JP-A-5-45828, JP-A-5-45834 and so on.

Those spectral sensitizing dyes are used alone or as a combination of two or more thereof. The combination of dyes is employed for the purpose of controlling the wavelength distribution of spectral sensitivity or obtaining supersensitizing effect. The supersensitizing combination of dyes can achieve the sensitivity materially greater than the sum of the sensitivities achieved by individual dyes.

It is also desirable to employ compounds which can exhibit a supersensitizing effect in combination with a certain sensitizing dye although they themselves do not spectrally sensitize silver halide emulsion or do not absorb light in the visible region. Such supersensitizing compounds include diaminostilbene compounds. Examples thereof are disclosed in U.S. Pat. No. 3,615,641, JP-A-63-23145 and so on.

Those spectral sensitizing dyes and supersensitizing compounds may be added to silver halide emulsions at any stage of emulsion-making. Specifically, they may be added to a chemically sensitized emulsion at the time of preparing a coating solution using the emulsion, or their addition to an emulsionmaybe at the conclusion of, during or prior to chemical sensitization, or they may be added within a period from the completion of grain formation to the start of desalting, during the grain formationor prior to the grain formation. These ways of addition may be adopted independently or as combination of two or more thereof. For achievement of high sensitivity, the addition in steps prior to chemical sensitization is effective.

The spectral sensitizing dyes and supersensitizing compounds each can be added in an amount chosen from a wide range depending on the shape and size of emulsion grains and the photographic characteristics intended to be conferred thereby. In general, however, the addition amount ranges from $10^{-8}$ to $10^{-1}$ mole, preferably from $10^{-5}$ to $10^{-2}$ mole, per mole of silver halide. Those compounds are dissolved in an organic solvent, such as methanol or fluorinated alcohol, or dispersed into water together with a surfactant and gelatin, and then added to silver halide emulsions.

The silver halide emulsions used in the present invention can contain a wide variety of stabilizers for purposes of preventing fogging or heightening stability during storage. Suitable examples of a stabilizer include nitrogen-containing heterocyclic compounds such as azaindenes, triazoles, tetrazoles and purines, and mercapto compounds such as mercaptotetrazoles, mercaptotriazoles, mercaptoimidazoles and mercaptothiadiazoles. The detials of these compounds are described in T. H. James, *The Theory of the Photographic Process*, pages 396–399, Macmillan (1977) and the references cited therein.

Of those antifoggants, the mercaptotriazoles having an alkyl group containing at least 4 carbon atoms and two or more aromatic groups as substituents are preferably used in the present invention.

Such antifoggants or stabilizers may be added to silver halide emulsions at any stage of emulsion-making. Specifically, they may be added within a period from the conclusion of chemical sensitization to the start of preparing a coating solution, at the conclusion of, during or prior to chemical sensitization, within a period from the completion of grain formation to the start of desalting, during the grain formation, or prior to the grain formation. These ways of addition may be adopted independently or as combination of two or more thereof.

Those antifoggants or stabilizers can be added in an amount chosen from a wide range depending on the halide composition of emulsion grains and the required purpose. In general, however, the addition amount ranges from $10^{-6}$ to $10^{-1}$ mole, preferably from $10^{-5}$ to $10^{-2}$ mole, permole of silver halide.

The aforementioned photographic additives which are usable in the present invention are described in *Research Disclosure* (abbreviated as "RD"), No. 17643 (December, 1978), No. 18716 (November, 1979) and No. 307105 (November, 1989). The locations where the additives are described in each of those references are listed below.

| Kinds of Additives | RD-17643 | RD-18716 | RD-307105 |
|---|---|---|---|
| Chemical sensitizer | p. 23 | p. 648, right column | p. 866 |
| Sensitivity increasing agent | | p. 648, right column | |
| Spectral sensitizer and Supersensitizer | pp. 23–24 | p. 648, right column, to p. 649, right column | pp. 866–868 |
| Brightening agent | p. 24 | p. 648, right column | p. 868 |
| Antifoggant and Stabilizer | pp. 24–26 | p. 649, right column | pp. 868–870 |
| Light absorbent, Filter dye, and UV absorbent | pp. 25–26 | p. 649, right column, to p. 650, left column | p. 873 |
| Dye image stabilizer | p. 25 | p. 650, left column | p. 872 |
| Hardener | p. 26 | p. 651, left column | pp. 874–875 |
| Binder | p. 26 | p. 651, left column | pp. 873–874 |
| Plasticizer and Lubricant | p. 27 | p. 650, right column | p. 876 |
| Coating aid and Surfactant | pp. 26–27 | p. 650, right column | pp. 875–876 |
| Antistatic agent | p. 27 | p. 650, right column | pp. 876–877 |
| Matting agent | | | pp. 878–879 |

In the present invention, it is also possible to use organic metal salts as oxidizing agent together with light-sensitive silver halide. Of such organic metal salts, organic silver salts are preferred in particular.

Examples of an organic compound usable for the formation of an organic silver salt as oxidizing agent include the benzotriazoles disclosed in U.S. Pat. No. 4,500,626, columns 52–53, and fatty acids. In addition, acetylene silver disclosed in U.S. Pat. No. 4,775,613 is also useful. Those organic silver salts may be used as a mixture of two or more thereof.

Such an organic silver salt can be used in an amount of 0.01 to 10 moles, preferably 0.01 to 1 mole, per mole of light-sensitive silver halide.

The binders used for constituent layers of the present photographic material are preferably hydrophilic ones as described in *Research Disclosure*, the above-cited numbers, and JP-A-64-13546, pages 71–75. More specifically, transparent or translucent hydrophilic binders are preferred. Examples of such binder include natural compounds, such as proteins (e.g., gelatin, gelatin derivatives) and polysaccharides (e.g., cellulose derivatives, starch, gum arabic, dextran, pullulan), and synthetic macromolecular compounds, such as polyvinyl alcohol, modified polyvinyl alcohols (e.g., terminal alkyl-modified Poval MP103 and MP203 produced by Kraray Co., Ltd.) In addition, the binders having high water-absorbing power as disclosed in, e.g., U.S. Pat. No. 4,960,681 and JP-a-62-245260, specifically homopolymers of vinyl monomers having —COOM or —$SO_3M$ group (wherein M is a hydrogen atom or an alkali metal), copolymers of vinyl monomers which are different from eachother but have the foregoing group and copolymers of vinyl monomers having the foregoing group and other vinyl monomers (e.g., sodium methacrylate, ammonium methacrylate), such as Sumica Gel L-5H produced by Sumitomo Chemical Co., Ltd., can also be employed. These binders can be used as a combination of two or more thereof. In particular, the combined use of gelatin and another binder as recited above is preferred. The gelatin can be selected properly from lime-processed gelatin, acid-processed gelatin and the so-called delimed gelatin, or gelatin reduced in contents of calcium and the like, depending on various purposes. It is also desirable to use these types of gelatin as a mixture.

In the present invention, the suitable coverage of binder is from 1 to 20 g/$m^2$, preferably 2 to 15 g/$m^2$, more preferably from 3 to 12 g/$m^2$. The proportion of gelatin to the total binders is from 50 to 100%, preferably from 70 to 100%.

The effects of the present invention can further be enhanced by incorporating a color developing agent in the present photographic material. It is desirable that the incorporated developing agent be a compound of formula (I), (II), (III) or (IV) illustrated hereinbefore.

The compounds represented by formula (I) are compounds generically referred to as sulfonamidophenols.

Each of the substituents $R_1$ to $R_4$ in Formula (I) represents a hydrogen atom, a halogen atom (e.g., chlorine, bromine), an alkyl group (e.g., methyl, ethyl, isopropyl, n-butyl, t-butyl), an aryl group (e.g., phenyl, tolyl, xylyl), an alkylcarbonamido group (e.g., acetylamino, propionylamino, butyroylamino), an arylcarbonamido group (e.g., benzoylamino), an alkylsulfonamido group (e.g., methanesulfonylamino, ethanesulfonylamino), an arylsulfoamido group (e.g., benzenesulfonylamino, toluenesulfonylamino), an alkoxygroup (e.g., methoxy, ethoxy, butoxy), an aryloxy group (e.g., phenoxy), an alkylthio group (e.g., methylthio, ethylthio, butylthio), an arylthio group (e.g., phenylthio, tolylthnio), an alkylcarbamoyl group (e.g., methylcarbamoyl, dimethylcarbamoyl, ethylcarbamoyl, diethylcarbamoyl, dibutylcarbamoyl, peperidylcarbamoyl, morpholylcarbamoyl), an arylcarbamoyl group (e.g., phenylcarbamoyl, methylphenylcarbamoyl, ethylphenylcarbamoyl, benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, morpholylsulfamoyl), an arylsulfamoyl group (e.g., phenylsulfamoyl, methylphenylsulfamoyl, ethylphenylsulfamoyl, benzylphenylsulfamoyl), a sulfamoyl group, a cyano group, an alkylsulfonyl group (e.g., methanesulfonyl, ethanesulfonyl), an arylsulfonyl group (e.g., phenylsulfonyl, 4-chlorophenylsulfonyl, p-toluenesulfonyl), an alkoxycarbonyl group (e.g., methoxycarbonyl, ethoxycarbonyl, butoxycarbonyl), an aryloxycarbonyl group (e.g., phenoxycarbonyl), an alkylcarbonyl group (e.g., acetyl, propionyl, butyroyl), an arylcarbonyl group (e.g., benzoyl, alkyllbenzoyl) or an acyloxy group (e.g., acetyloxy, propionyloxy, butyroyloxy). Of the substituents $R_1$ to $R_4$, both $R_2$ and $R_4$ are preferably hydrogen atoms. Further, it is desirable that the Hammett's $\sigma_p$ values of substituents $R_1$ to $R_4$ have a total of at least zero.

$R_5$ represents an alkyl group (e.g., methyl, ethyl, butyl, octyl, lauryl, cetyl, stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl, 3,5-di-(methoxycarbonyl)), or a heteroyclic group (e.g., pyridyl).

The compounds of formula (II) are compounds generically referred to as carbamoylhydrazines. And the compounds of formula (IV) are compounds generically referred to as sulfonylhydrazines.

In these formulae, Z represents atoms completing an aromatic ring. The aromatic ring completed by Z is required to be sufficiently electron-attracting for imparting silver developing activity to the present compound. For satisfying this requirement, it is advantageous for Z to complete a nitrogen-containing aromatic ring or a benzene ring onto which electron-attracting group(s) is(are) introduced. Suitable examples of such an aromatic ring include a pyridine ring, a pyrazine ring, a pyrimidine ring, a quinoline ring and quinoxaline ring.

Examples of a substituent group which can be introduced onto the benzene ring completed by Z include alkylsulfonyl groups (e.g., methanesulfonyl, ethanesulfonyl), halogen atoms (e.g., chlorine, bromine), alkylcarbamoyl groups (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl groups (e.g., phenylcarbamoyl, methylphenylcarbamoyl, ethylphenylcarbamoyl, benzylphenylcarbamoyl), a carbamoyl group, alkylsulfamoyl groups (e.g., methylsulfamoyl, dimethylsulfamoyl, ethylsulfamoyl, diethylsulfamoyl, dibutylsulfamoyl, piperidylsulfamoyl, morpholylsulfamoyl), arylsulfamoyl groups (e.g., phenylsulfamoyl, methylphenylsulfamoyl, ethylphenylsulfamoyl, benzylphenylsulfamoyl), a sulfamoyl group, a cyano group, alkylsulfonyl groups (e.g., methanesulfonyl, ethanesulfonyl), arylsulfonyl groups (e.g., phenylsulfonyl, 4-chlorophenylsulfonyl, p-toluenesulfonyl), alkoxycarbonyl groups (e.g., methoxycarbonyl, ethoxycarbonyl, butoxycarbonyl), aryloxycarbonyl groups (e.g., phenoxycarbonyl), alkylcarbonyl groups (e.g., acetyl, propionyl, butyroyl) and arylcarbonyl groups (e.g., benzoyl, alkylbenzoyl). Only the Hammett's $\sigma$ values of substituent groups introduced onto the benzene ring come to a total of at least 1.

The compounds represented by formula (III) are compounds generically referred to as carbamoylhydrazones.

In formula (III), $R_6$ represents a substituted or unsubstituted alkyl group (e.g., methyl, ethyl); X represents an oxygen atom, a sulfur atom, a selenium atom or an alkyl- or aryl-substituted tertiary nitrogen atom, preferably an alkyl-substituted tertiary nitrogen atom; and $R_7$ and $R_8$ each represent a hydrogen atom or a substituent group, or $R_7$ and $R_8$ are combined with each other to form a double bond or a ring.

Examples of compounds representedby formulae (I) to (IV) are illustrated below, but it should be understood that these examples are not to be construed as limiting the scope of the invention in any way.
D-1
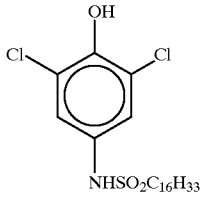
D-2
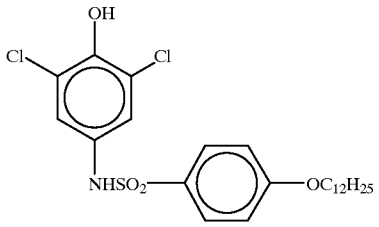
D-3
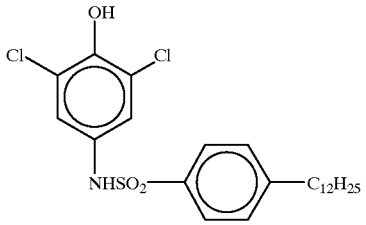
D-4
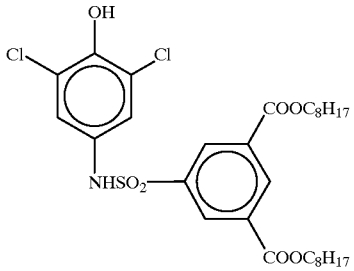
D-5
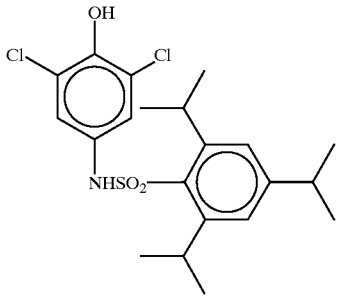
D-6
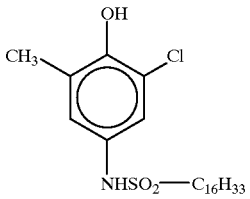
-continued
D-7
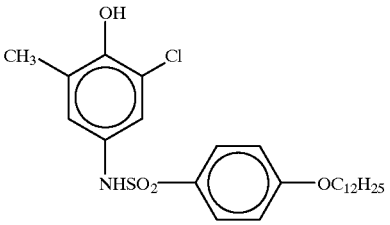
D-8
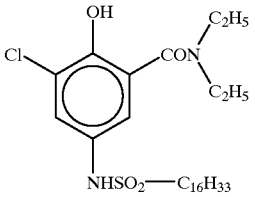
D-9
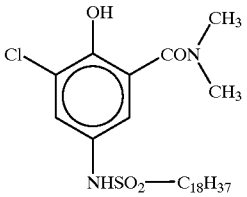
D-10
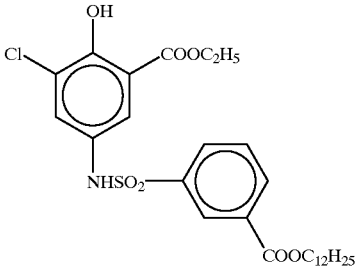
D-11
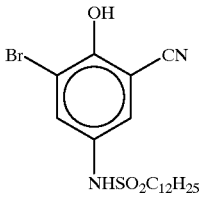
D-12
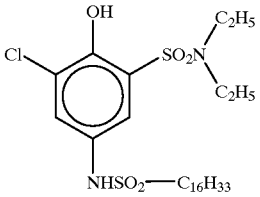
D-13
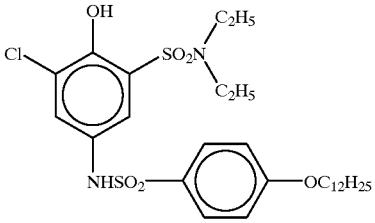

-continued
D-14
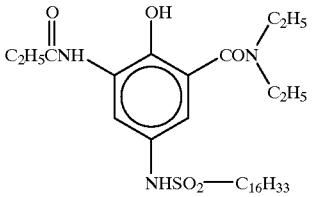
D-15
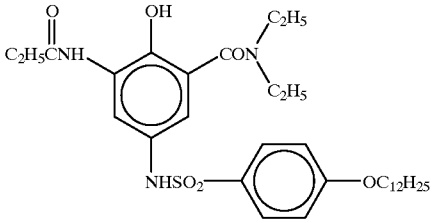
D-16
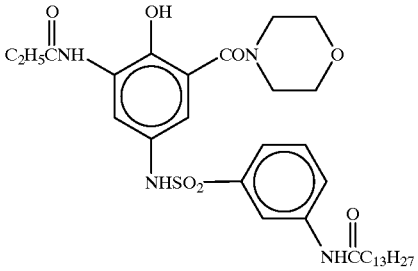
D-17
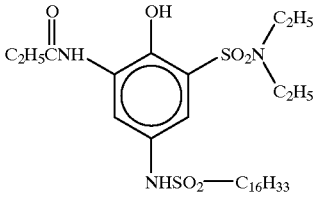
D-18
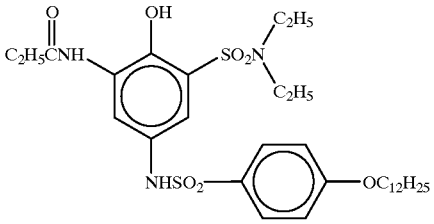
D-19
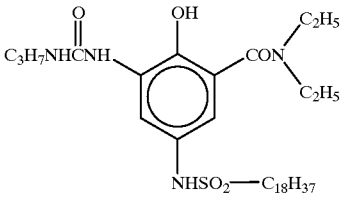
D-20
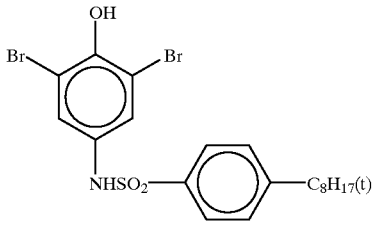
-continued
D-21
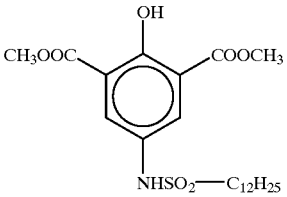
D-22
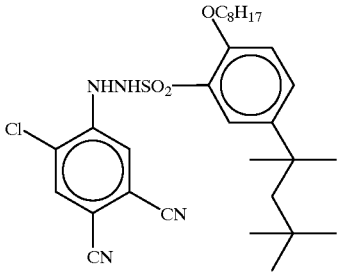
D-23
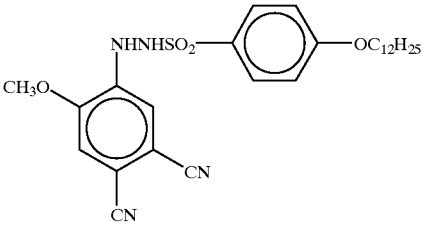
D-24
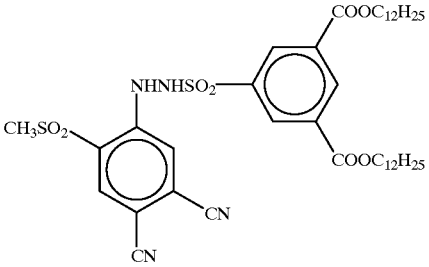
D-25
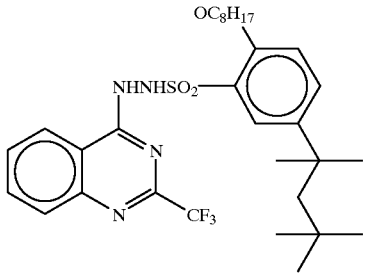
D-26
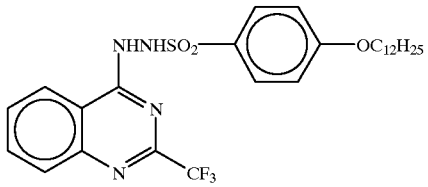

-continued
D-27
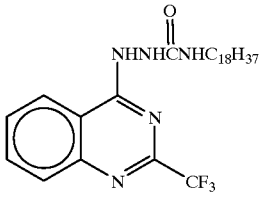
D-28
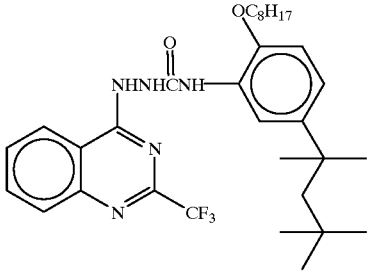
D-29
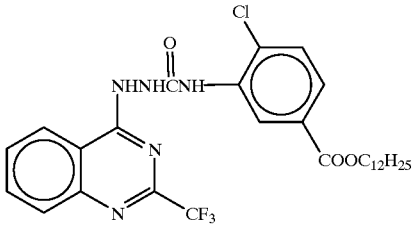
D-30
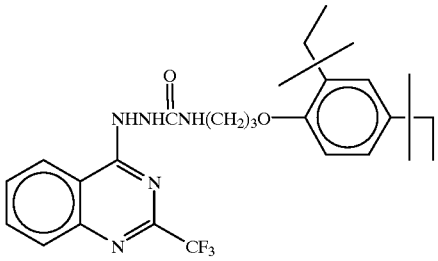
D-31
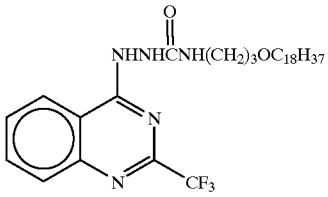
D-32
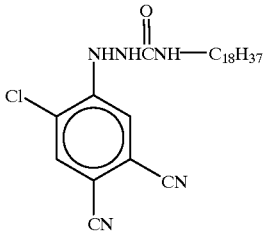
-continued
D-33
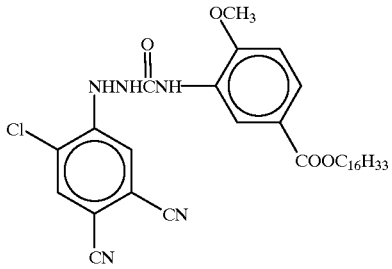
D-34
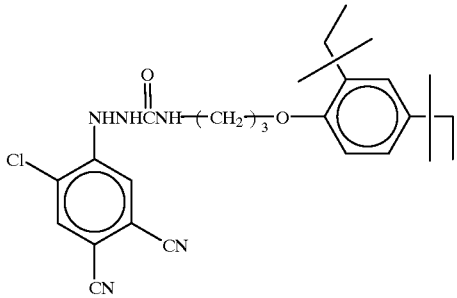
D-35
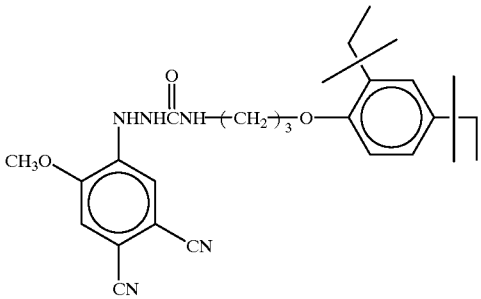
D-36
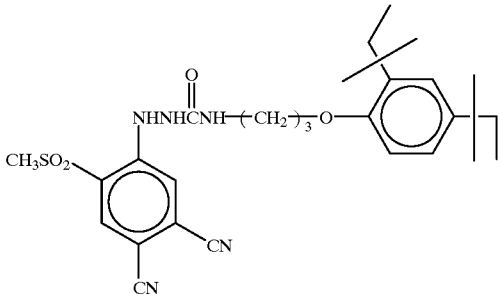
D-37
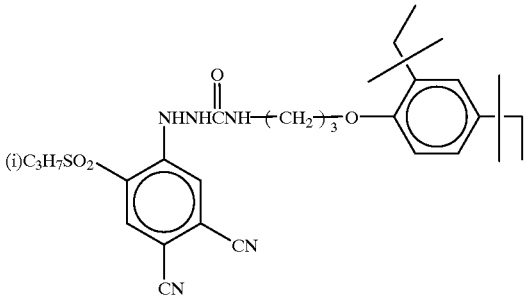

-continued
D-38
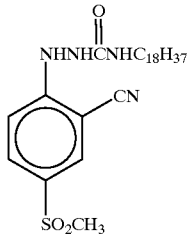
D-39
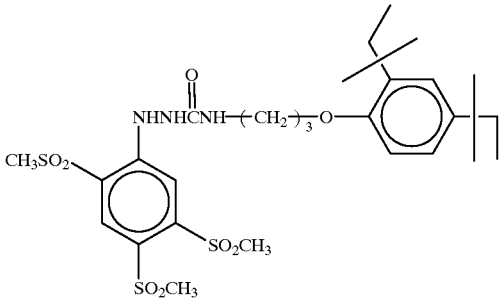
D-40
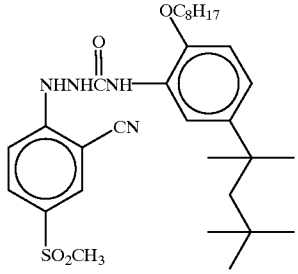
D-41
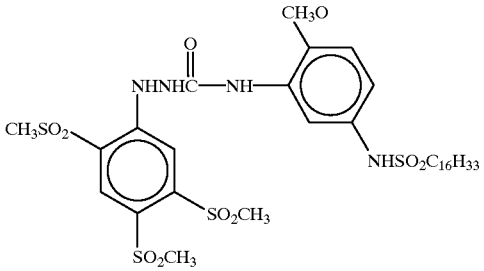
D-42
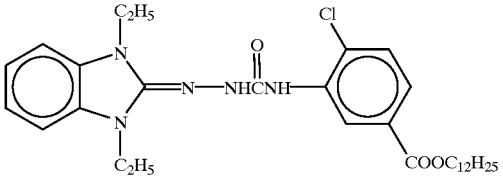
D-43
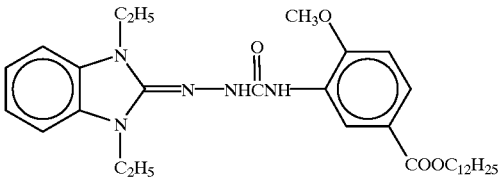
-continued
D-44
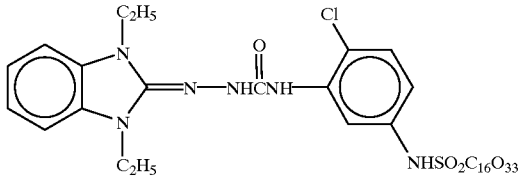
D-45
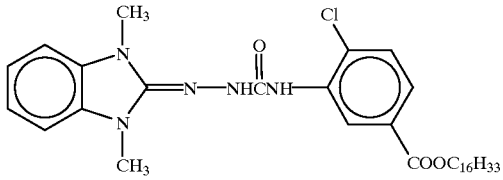
D-46
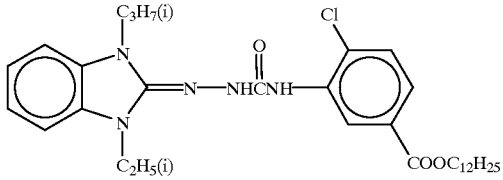
D-47
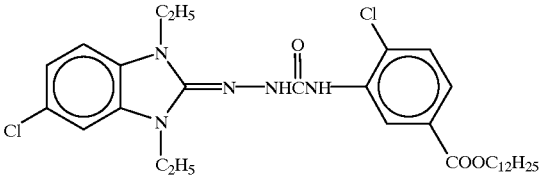
D-48
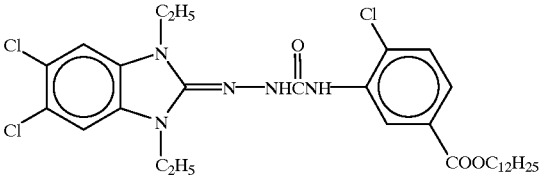
D-49
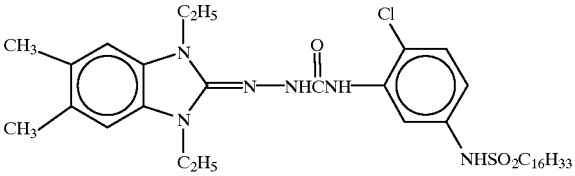
D-50
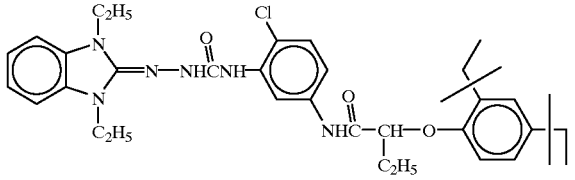
D-51
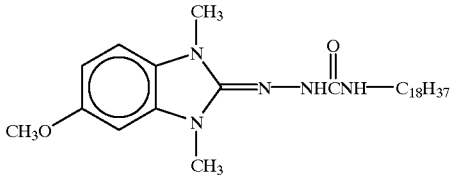

-continued

D-52

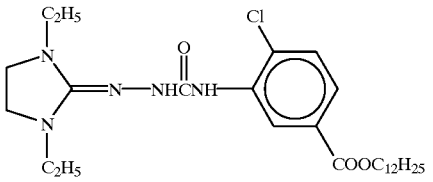

D-53

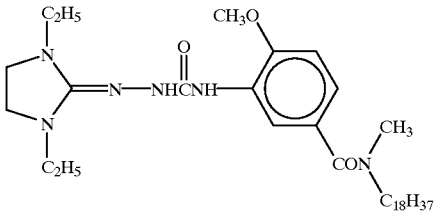

D-54

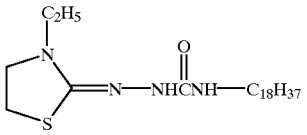

D-55

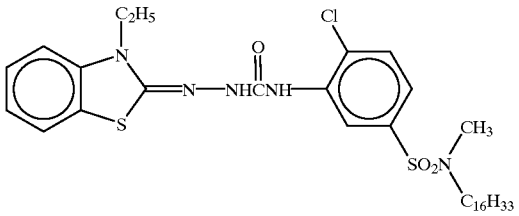

D-56

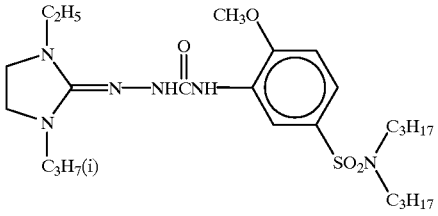

One or more of the foregoing compounds are employed as color developing agent. It is also possible to use different developing agents in constituent layers respectively. The total amount of these developing agents used is from 0.05 to 20 mmol/$m^2$, preferably from 0.1 to 10 mmol/$m^2$.

Next, couplers are illustrated. The term "couplers" as used herein refers to the compounds forming dyes by the coupling reaction with the oxidation products of color developing agents.

The couplers preferably used in the present invention include active methylene compounds, 5-pyrazolone compounds, pyrazoloazole compounds, phenol compounds, naphthol compounds and pyrrolotriazole compounds. As these compounds, the compounds recited in "X. Dye image formers and modifiers" RD No. 38957, pp. 616–624 (September, 1996) can be advantageously employed.

Those couplers can be divided into two groups, two equivalent couplers and four equivalent couplers. Examples of a group functioning as the anionic splitting-off group of two equivalent coupler include halogen atoms (e.g., chlorine, bromine), alkoxygroups (e.g., methoxy, ethoxy), aryloxygroups (e.g., phenoxy, 4-cyanophenoxy, 4-alkoxycarbonylphenyl), alkylthio groups (e.g., methylthio, ethylthio, butylthio), arylthio groups (e.g., phenylthio, tolylthio), alkylcarbamoyl groups (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl groups (e.g., phenylcarbamoyl, methylphenylcarbamoyl, ethylphenylcarbamoyl, benzylphenylcarbamoyl), a carbamoyl group, alkylsulfamoyl groups (e.g., methylsulfamoyl, dimethylsulfamoyl, ethylsulfamoyl, diethylsulfamoyl, dibutylsulfamoyl, piperidylsulfamoyl, morpholylsulfamoyl), arylsulfamoyl groups (e.g., phenylsulfamoyl, methylphenylsulfamoyl, ethylphenylsulfamoyl, benzylphenylsulfamoyl), a sulfamoyl group, a cyano group, alkylsulfonyl groups (e.g., methanesulfonyl, ethanesulfonyl), arylsulfonyl groups (e.g., phenylsulfonyl, 4-chlorophenylsulfonyl, p-toluenesulfonyl), alkylcarbonyloxy groups (e.g., acetyloxy, propionyloxy, butyroyloxy), arylcarbonyloxy groups (e.g., benzoyloxy, toluyloxy, anisyloxy) and nitrogen-containing heterocyclic groups (e.g., imidazolyl, benzotriazolyl).

Examples of a group functioning as the cationic splitting-off group of a four equivalent coupler include a hydrogen atom, a formyl group, a carbamoyl group, an acyl group, a sulfonyl group and a methylene group substituted by, e.g., an aryl group, a sulfamoyl group, a carbamoyl group, an alkoxy group, an amino group or a hydroxyl group.

Besides the compounds described in RD No. 38957, the couplers recited below can be favorably used.

Appropriate examples of an active methylene coupler include the couplers represented by formulae (I) and (II) in EP-A-0502424; the couplers represented by formulae (1) and (2) in EP-A-0513496; the couplers represented by formula (I) in claim 1 of EP-A-0568037; the couplers represented by formula (I) on column 1, lines 45–55, of U.S. Pat. No. 5,066,576; the couplers represented by formula (I) in paragraph [0008] of JP-A-4-274425: the couplers described in claim 1 on page 40 of EP-A1-0498381; the couplers represented by formula (Y) on page 4 of EP-A1-0447969; and the couplers represented by formulae (II) to (IV) on column 7, lines 36–58, of U.S. Pat. No. 4,476,219.

Apt examples of a magenta coupler of 5-pyrazolone type include the compounds disclosed in JP-A-57-35858 and JP-A-51-20826.

Suitable examples of pyrazoloazole couplers include the imidazo[1,2-b]pyrazoles disclosed in U.S. Pat. No. 4,500,630, the pyrazolo[1,5-b][1,2,4]triazoles disclosed in U.S. Pat. No. 4,540,654, and the pyrazolo[5,1-c][1,2,4]triazoles disclosed in U.S. Pat. No. 3,725,067. Of these couplers, the pyrazolo[1,5-b][1,2,4]triazoles are preferred over the others from the viewpoint of light fastness.

Suitable examples of phenol couplers include the 2-alkylamino-5-alkylphenol couplers as disclosed in U.S. Pat. Nos. 2,369,929, 2,810,171, 2,772,162, 2,895,826 and 3,772,002; the 2,5-diacylaminophenol couplers as disclosed in U.S. Pat. Nos. 2,772,162, 3,758,308, 4,126,396, 4,334,011 and 4,327,173, West German Patent Application (OLS) No. 3,329,729, and JP-A-59-166956; and the 2-phenylureido-5-acylaminophenol couplers as disclosed in U.S. Pat. Nos. 3,446,622, 4,333,999, 4,451,559 and 4,427,767.

Suitable examples of naphthol couplers include the 2-carbamoyl-1-naphthol couplers as disclosed in U.S. Pat. Nos. 2,474,293, 4,052,212, 4,146,396, 4,228,233 and 4,296,200; and the 2-carbamoyl-5-amido-1-naphthol couplers as disclosed in U.S. Pat. No. 4,690,889.

Suitable examples of pyrrolotriazole couplers include the couplers disclosed in EP-A1-0488248, EP-A1-0491197 and EP-A1-0545300.

In addition to the couplers recited above, the couplers having particular structures, such as ring-condensed phenols, imidazoles, pyrroles, 3-hydroxypyridines, active methylenes, 5,5-condensed hetero rings or 5,6-condensed hetero rings, can also be used.

As for the ring-condensed phenol couplers which can be used, the couplers disclosed in U.S. Pat. Nos. 4,327,173, 4,564,586 and 4,904,575 are examples thereof.

As for the imidazole couplers which can be used, the couplers disclosed in U.S. Pat. Nos. 4,818,672 and 5,051,347 are examples thereof.

As for the pyrrole couplers which can be used, the couplers disclosed in JP-A-4-188137 and JP-A-4-190347 are examples thereof.

As for the 3-hydroxypyridine couplers which can be used, the couplers disclosed in JP-A-1-315736 are examples thereof.

As for the active methylene couplers which can be used, the couplers disclosed in U.S. Pat. Nos. 5,104,783 and 5,162,196 are examples thereof.

As for the 5,5-condensed hetero ring couplers which can be used, the pyrrolopyrazole couplers disclosed in U.S. Pat. No. 5,164,289 and the pyrroloimidazole couplers disclosed in JP-A-4-174429 are examples thereof.

As for the 5,6-condensed hetero ring couplers which can be used, the pyrazolopyrimidine couplers disclosed in U.S. Pat. No. 4,950,585, the pyrrolotriazine couplers disclosed in JP-A-4-204730 and the couplers disclosed in European Patent 0,556,700 are examples thereof.

Further, other couplers, including the couplers disclosed in West German Patent Application (OLS) No. 3,819,051, West German Patent 3,823,049, U.S. Pat. Nos. 4,840,883, 5,024,930, 5,051,347 and 4,481,268, EP-A2-0304856, European Patent 0,329,036, EP-A2-0354549, EP-A2-0374781, EP-A2-0379110, EP-A1-0386930, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-204731 and JP-A-204732, can be used in the present invention, too.

The couplers as recited above are used in an amount of 0.05 to 10 mmol/$m^2$, preferably 0.1 to 5 mmol/$m^2$, per each color.

Furthermore, the following functional couplers may be incorporated in the present photographic material.

As for the couplers which can produce colored dyes having moderate diffusibility, the couplers disclosed in U.S. Pat. No. 4,366,237, GB Patent 2,125,570, EP-B-0096873 and DE 3,234,533 are suitable examples thereof.

Examples of couplers usable for correcting unnecessary absorption of color-developed dyes include the yellow colored cyan couplers disclosed in EP-A1-0456257, the yellow colored magenta couplers disclosed in the EP cited above, the magenta colored cyan couplers disclosed in U.S. Pat. No. 4,833,069, and the colorless masking couplers represented by (2) in U.S. Pat. No. 4,837,136 and Formula (A) in claim 1 of WO 92/11575 (especially, the compounds exemplified on pages 36–45).

With respect to compounds (including couplers) releasing photographically useful compound residues by reacting with oxidation products of developing agents, the following are examples thereof:

As examples of a development inhibitor-releasing compound, mention may be made of the compounds represented by formulae (I) to (IV) on page 11 of EP-A1-0378236, the compounds represented by formula (I) on page 7 of EP-A2-0436938, the compounds represented by formula (1) in EP-A-0568037 and the compounds represented by formulae (I), (II) and (III) on pages 5–6 of EP-A2-0440195.

As examples of a bleach accelerator-releasing compound, mention may be made of the compounds represented by formulae (I) and (I') on page 2 of EP-A2-0310125 and the compounds represented by formula (I) in claim 1 of JP-A-6-59411.

As examples of a ligand-releasing compound, mention may be made of the compounds represented by LIG-X in claim 1 of U.S. Pat. No. 4,555,478.

As examples of a leuco dye-releasing compound, mention may be made of the Compounds 1 to 6 illustrated on columns 3–8 of U.S. Pat. No. 4,749,641.

As examples of a fluorescent dye-releasing compound, mention may be made of the compounds represented by COUP-DYE in claim 1 of U.S. Pat. No. 4,774,181.

As examples of a development accelerator- or fogging agent-releasing compound, mention may be made of the compounds represented by formulae (1), (2) and (3) on column 3 of U.S. Pat. No. 4,656,123 and the compounds represented by ExZK-2 on page 75, lines 36–38, of EP-A2-0450637.

As examples of a compound releasing a group which is conveerted into a dye only when it leaves the compound, mention may be made of the compounds represented by formula (I) in claim 1 of U.S. Pat. No. 4,857,447, the compounds represented by formula (I) in JP-A-5-307248, the compounds represented by formulae (I), (II) and (III) on pages 5–6 of EP-A2-0440195, the ligand releasing compounds represented by formula (I) in claim 1 of JP-A-6-59411 and the compounds represented by LIG-X in claim 1 of U.S. Pat. No. 4,555,478.

It is desirable for such functional couplers to be used in an amount of 0.05–10 times by mole, preferably 0.1–5 times by mole, that of couplers contributing to color development.

The hydrophobic additives, including couplers and color developing agents, can be introduced into constituent layers of the present photographic material by the use of a known method, e.g., the method disclosed in U.S. Pat. No. 2,322,027.

In this case, the high boiling organic solvents as disclosed in U.S. Pat. Nos. 4,555,470, 4,536,466, 4,536,467, 4,587,206, 4,555,476 and 4,599,296 and JP-B-3-62256 can be employed, if needed, in combination with low boiling organic solvents having a boiling point in the range of 50–160° C. Additionally, those dye-providing couplers, high boiling organic solvents or so on can be used alone or as a combination of two or more thereof.

The amount of high boiling organic solvent(s) used is not higher than 10 g, preferably not higher than 5 g, more preferably from 1 to 0.1 g, per gram of hydrophobic additives. In a case of using high boiling organic solvent(s) for binder, the suitable volume thereof is not greater than 1 cc, preferably not greater than 0.5 cc, particularly preferably not greater than 0.3 cc, per gram of binder.

Further, the dispersion method using the polymers disclosed in JP-B-51-39853 and JP-A-51-59943, and the method of adding hydrophobic additives in the form of fine particle dispersions as disclosed in JP-A-62-30242 can also be adopted.

Besides using the methods mentioned above, the compounds which are substantially insoluble in water can be incorporated as a dispersion of fine particles in binder.

In dispersing hydrophobic compounds into hydrophilic colloid, various kinds of surfactants can be used. For instance, the surfactants described in JP-A-59-157639, pages 37–38, and *Research Disclosure*, the above-cited numbers, can be employed. In addition thereto, the phosphate surfactants disclosed in JP-A-7-56267 and JP-A-7-228589, and West German Patent Application (OLS) No. 1,932,299 can also be used.

The present photographic material is required to have on a support at least three light-sensitive layers differing from one another in spectral sensitivity conferred thereon. As a typical example thereof, mention may be made of a silver halide photographic material having on a support at least three types of light-sensitive layers which are each constituted of two or more layers having substantially the same color sensitivity but different speeds. Each of those light-sensitive layers is a unit light-sensitive layer having color sensitivity to any of blue light, green light and red light. As for the arranging order of unit light-sensitive layers in a multi-layer silver halide color photographic material, the unit red-sensitive layer, the unit green-sensitive layer and the unit blue-sensitive layer are generally arranged in this order, based on the distance from the support. However, if desired, the foregoing arranging order may be reversed, or other arranging orders may be adopted wherein a constituent layer of one unit light-sensitive layer is inserted between constituent layers of another unit light-sensitive layer. Further, light-insensitive layers may be arranged between silver halide light-sensitive layers and/or as the uppermost layer or the lowest layer. In these layers, the aforementioned couplers, developing agents, DIR compounds, color stain inhibitors, dyes and the like maybe incorporated. As for the two or more silver halide emulsion layers constituting a unit light-sensitive layer, it is desirable that two layers, namely high speed emulsion layer and low speed emulsion layer, be arranged over a support in order of increasing speed, as described in DE 1,121,470 or GB 923,045. Conversely, as described in JP-A-57-112751, JP-A-62-200350, JP-A-62-206541 and JP-A-62-206543, it is also possible to adopt an arranging order such that a low speed emulsion layer is on the side distant from the support and a high speed emulsion layer is on the side near the support.

Suitable examples of an arranging order of light-sensitive layers include the arrangement of low speed blue-sensitive layer (BL)/high speed blue-sensitive layer (BH)/high speed green-sensitive layer (GH)/low speed green-sensitive layer (GL)/high speed red-sensitive layer (RH)/low speed red-sensitive layer (RL), the arrangement of BH/BL/GL/GH/RH/RL and the arrangement of BH/BL/GH/GL/RL/RH, described in decreasing order of distance from the support.

As additional examples, mention may be made of the arrangement of blue-sensitive layer/GH/RH/GL/RL disclosed in JP-B-55-34932 and the arrangement of blue-sensitive layer/GL/RL/GH/RH disclosed in JP-A-56-25738 and JP-A-62-63936, which are each described in decreasing order of distance from the support.

As still another example of an arranging order, mention may be made of the arrangement disclosed in JP-B-49-15495 wherein three constituent layers having different speeds are arranged over a support in order of increasing speed, namely the silver halide emulsion layer having the highest speed is arranged as the upper layer, that having the speed lower than the foregoing one is arranged as the intermediate layer and that having the lowest speed is arranged as the lower layer. In a case similar to the above wherein three constituent layers differing in speed are present, the arrangement disclosed in JP-A-59-202464, namely the arrangement of medium speed emulsion layer/high speed emulsion layer/low speed emulsion layer, described in increasing order of distance from the support, may also be adopted.

In addition, the arranging order of high speed emulsion layer/low speed emulsion layer/medium speed emulsion layer or that of low speed emulsion layer/medium speed emulsion layer/high speed emulsion layer may be adopted. In cases where four or more constituent layers are present, various arranging orders as mentioned above can be adopted, too.

In the present invention, it is desirable to incorporate at least two kinds of silver halide emulsions having their sensitivity in the same wavelength region but different average grain projected areas. The expression "having their sensitivity in the same wavelength region" as used herein means to have their respective speeds in the wavelength regions regarded as effectively similar. Therefore, even if emulsions differ subtly in spectral sensitivity distribution, they are regarded as emulsions having the sensitivity in the same wavelength region so long as they overlap in main sensitive region.

As for the difference in average grain projected area between emulsions, it is desirable that the average grain projected area of one emulsion be at least 1.25 times, preferably at least 1.4 times, especially at least 1.6 times, as large as that of another emulsion. In cases where at least three kinds of emulsions are used, it is desirable that there be the foregoing relation between the emulsions having the smallest average grain projected area and the emulsion having the greatest one.

In incorporating two or more emulsions having their sensitivity in the same wavelength region but differing in average grain projected area, the emulsions may be formed into separate layers, or they may be mixed together and formed into a single layer.

In the case of incorporating those emulsions into separate layers, it is desirable that the emulsion having a larger average grain projected area be arranged as upper layer (at the position nearer the incident light).

In the case of incorporating those emulsions into separate sensitive layers, it is desirable that the emulsions be combined with color couplers having the same hue. However, the sensitive layers may be designed so as to develop colors differing in hue by combining emulsions with couplers forming different colors respectively, or couplers differing in absorption profile of developed color hue may be used in sensitive layers respectively.

In coating at least two kinds of silver halide emulsions having spectral sensitivity in the same wavelength region and different average grainprojected area, it is desirable for them to be constructed so that a ratio of grain number per unit area of an emulsion having larger average grain projected area to that number of an emulsion having smaller average grain projected area is greater than a ratio of the value obtained by dividing the coated silver amount by the $3/2^{nd}$ power of average grain projected area of an emulsion having larger average grain projected area to that value of an emulsion having smaller average grain projected area. By selecting such a design, images having satisfactory graininess can be formed even under the condition of high temperature development. Moreover, such a design can satisfy the requirements for high developability and wide exposure latitude at the same time.

In the total silver coverage of the photographic material which is specified in order to achieve the present effects, not only the coverage of silver halide contained in those silver halide emulsions but also the coverage of light-insensitive silver halide contained in light-sensitive and light-insensitive layers, the coverage of organic silver salt used as oxidizing agent and the coverage of colloidal silver contained in antihalation and yellow filter layers are included collectively as the values reduced to a metallic silver basis.

In color negative films used in conventional photography, the intended granularity has been achieved by combining the art of utilizing the so-called DIR couplers, namely couplers releasing development inhibitive compounds upon reaction with the oxidation products of developing agents, with improved silver halide emulsions. In the present invention, on the other hand, excellent granularity can be achieved even when no DIR coupler is incorporated into the photographic material. And the incorporation of a DIR coupler into the present photographic material can further enhance the granularity.

In order to improve the color reproducibility, it is desirable that the donor layers (CL) having interlayer effect and spectral sensitivity distributions different from main light-sensitive layers, such as BL, GL and RL, be arranged in contact with or vicinity of main light-sensitive layers respectively, asdisclosed in U.S. Pat. Nos. 4,663,271, 4,705,744 and 4,707,436, JP-A-62-160448 and JP-A-63-89850.

In the present invention, silver halide, a dye-providing coupler and a color developing agent may be incorporated in the same layer, but can be added to separate layers so far as they are in a reactive state. For instance, the storage stability of unexposed photographic material can be elevated by incorporating a color developing agent and silver halide into separate layers.

In order to constitute a photographic material which enables the recording of an original scene and its reproduction as a color image, the subtractive color process can be basically employed in the present invention. More specifically, the color information of an original scene can be recorded by arranging at least three light-sensitive layers having sensitivity in the blue, green and red regions respectively, and incorporating in those layers respectively the color couplers forming yellow, magenta and cyan dyes bearing complementary color relations to their individual sensitive wavelength regions. And the original scene can be reproduced by exposing color photographic paper having the same relation between the sensitive wavelength region and the developed color hue via the dye images obtained above. Also, the information of dye images obtained by taking an original scene can be read by means of a scanner or the like and an image for appreciation can be reproduced on a basis of this information.

As the photosensitive material of the present invention, a light-sensitive layer having photosensitivity in at least three kinds of wavelength region may be provided.

Further, it is possible to have the relation between the light-sensitive wavelength region and the developed color hue, other than the above complementary color relation. In this case, the original color information can be reproduced by applying image processing such as hue conversion after taking the image information as described above.

In each layer, there may be any relation between the. spectral sensitivity and the hue of the couplers incorporated. However, such a relation as to use a cyan coupler in a red-sensitive layer, a magenta coupler in a green-sensitive layer and a yellow coupler in a blue-sensitive layer enables direct projection exposure of conventional color paper.

In the present photographic material, various light-insensitive layers, including a protective layer, a subbing layer, an interlayer, a yellow filter layer and an antihalation layer, may be provided between any two of the silver halide emulsion layers mentioned above, or as the uppermost layer or the lowest layer. Further, auxiliary layers such as a backing layer can be provided on the opposite side of the support. More specifically, the present photographic material can have the layer structures disclosed in the above-cited references, the subbing layer as disclosed in U.S. Pat. No. 5,051,335, the solid pigment-containing interlayer as disclosed in JP-A-1-167838 and JP-A-61-20943, the interlayers containing reducing agents and DIR compounds as disclosed in JP-A-1-120553, JP-A-5-34884 and JP-A-2-64634, the interlayers containing electron transfer agents as disclosed in U.S. Pat. Nos. 5,017,454 and 5,139,919 and JP-A-2-235044, the protective layer containing a reducing agent as disclosed in JP-A-4-249245, or the combination of those layers.

The dyes appropriately used in a yellow filter layer, a magenta filter layer or an antihalation layer which can be provided in the present invention are dyes of the kind which can be transferred into a processing material upon development or converted to colorless compounds by the reaction during development and thereby come to have densities reduced to no higher than one third, preferably no higher than one tenth, their densities right before coating. As a result, they have no contribution to the density of the photographic material after processing.

Examples of such dyes include the dyes disclosed in EP-A-0549489 and the dyes represented by ExF 2 to ExF 6 in JP-A-7-152129. In addition, the solid dye dispersions as disclosed in JP-A-8-101487 can also be employed.

On the other hand, dyes can be fixed to binder by means of a mordant. In this case, known dyes and mordants are usable. As examples of a mordant which can be used, mention may be made of the mordants disclosed in U.S. Pat. No. 4,500,626, columns 58–59, JP-A-61-88256, pages 32–41, JP-A-62-244043 and JP-A-62-244036.

Further, it is possible to use the combination of a reducing agent and a compound capable of releasing a diffusive dye upon reaction with a reducing agent. In this case, the compound releases a mobile dye in the presence of an alkali at the time of development, and the mobile dye is removed by transfer into a processing material. The details of such a combination are described in U.S. Pat. Nos. 4,559,290 and 4,783,396, EP-A2-0220746, Kokai Giho 87-6119, and Japanese Patent Application No. 6-259805, paragraphs [0080]–[0081].

Furthermore, it is possible to use leuco dyes which can lose color. For instance, JP-A-1-150132 discloses the silver halide photographic material containing a leuco dye which has the color previously developed by a metal salt of organic acid as a developer.

As a support of the present photographic material, transparent substances which can stand a processing temperature can be employed. As examples of such substances which can be generally employed, mention may be made of photographic supports described in *Shashin Kogaku no Kiso—Ginen Shashin Hen* (which means "The Fundamentals of Photographic Engineering—The silver halide photography volume), compiled by Japanese Photographic Society, published by Corona Publisher Co. (1979), pages 223–240, including various kinds of paper and synthetic polymer film. More specifically, films of polyethylene terephthalate, polyethylene naphthalate, polycarbonate, polyvinyl chloride, polystyrene, polypropylene, polyimide and celluloses (e.g., triacetyl cellulose) can be recited.

Of these films, polyesters containing polyethylene naphthalate as main component are preferred over the others. In the polyesters "containing polyethylene naphthalate as main component", the suitable proportion of naphthalenedicarboxylic acid to the total dicarboxylic acid residues is at least 50 mole %, preferably at least 60 mol %, more preferably at least 70 mol %. Such a polyester may be a copolymer or a blend of polyethylene naphthalate with another polyester.

It is desirable for such a copolymer to be prepared by copolymerizing naphthalenedicarbooxylic acid, ethylene glycol, and further terephthalic acid, bisphenol A, cyclohexanedimethanol and/or the like. Of these comonomers, terephthalic acid is preferred in particular from the viewpoints of mechanical strength and cost.

As polyesters blended with polyethylene naphthalate, polyethylene terephthalate (PET), polyarylate (PAr), polycarbonate (PC) and polycyclohexanedimethanol terephthalate (PCT) are preferable in view of miscibility. Of those polyesters, PET is most suitable for blending with respect to mechanical strength and cost.

In cases where strict requirements for heat resistance and curling characteristics are imposed on a photographic material, the supports disclosed in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-175282, JP-A-6-118561, JP-A-7-219129, JP-A-7-219144 and Japanese Patent Application Nos. 4-253545, 4-221538and5-21625 can be used as the support of the photographic material.

In addition, the supports mainly constituted of syndiotactic styrene polymers can be suitably used as well.

The suitable thickness of a support as recited above is from 5 to 200$\mu$, preferably from 40 to 120$\mu$.

For adhesion of a support to a constituent layer of the photographic material, it is desirable for the support to undergo surface treatment. As examples of such surface treatment, mention may be made of treatments for activation of the support surface, such as chemical treatment, mechanical treatment, corona discharge treatment, flame treatment, ultra violet treatment, high frequency treatment, glow discharge treatment, active plasma treatment, laser treatment, mixed acid treatment and ozone oxidation treatment. Of these surface treatments, UV irradiation treatment, flame treatment, corona treatment and glow treatment are preferred over the others.

The description of a subbing layer usable in the present photographic material is given below. The subbing layer may be a single layer, or constituted of two or more layers. Examples of a binder usable for the subbing layer include not only copolymers prepared using as starting materials two or more monomers selected from a group including vinyl chloride, vinylidene chloride, butadiene, methacrylic acid, acrylic acid, itaconic acid and maleic anhydride, but also various polymers, such as polyethyleneimine, epoxy resin, grafted gelatin, nitrocellulose, gelatin, polyvinyl alcohol and modified polymers thereof. Examples of a compound which can be added to the subbing layer for the purpose of swelling the support are resorcin and p-chlorophenol. Examples of a gelatin hardener which can be used in the subbing layer include chromium salts (e.g., chrome alum), aldehydes (e.g., formaldehyde, glutaraldehyde), isocyanates, active halogen compounds (e.g., 2,4-dichloro-6-hydroxy-s-triazine), epichlorohydrin resin and active vinylsulfone compounds. In addition, fine grains of inorganic compounds such as $SiO_2$ and $TiO_2$ and fine particles of methylmethacrylate copolymer (0.01 to 10 $\mu$m in size) may be incorporated as matting agent.

As for dyes used for dyeing films, the color tone thereof is preferably gray in view of general properties of photographic material. Further, it is desirable for the dyes to have excellent heat resistance in the film formation temperature region and satisfactory miscibility with polyester. From this point of view, the film dyeing can be effected by being mixed with commercially available dyes for polyester, e.g., Diaresin (trade name, produced by Mitsubishi Chemical Industries, Ltd.) and Kayaset (trade name, produced by Nippon Kayaku Co., Ltd.). In view of heat stability, on the other hand, anthraquinone dyes are favorable. For instance, it is desirable to use the dyes disclosed in JP-A-8-122970.

Moreover, it is desirable that the information about picture-taking be recorded by utilizing the support provided with a magnetic recording layer as disclosed in, e.g., JP-A-4-124645, JP-A-5-40321, JP-A-6-35092 or JP-A-6-317875.

The magnetic recording layer is a layer provided on a support by application of a composition containing a magnetic powder-dispersed binder in water or an organic solvent.

Examples of magnetic powder usable therein include powders of ferromagnetic iron oxides, such as $\gamma.Fe_2O_3$, Co-adherent $\gamma.Fe_2O_3$, Co-adherent magnetite, Co-containing magnetite, ferromagnetic chromium dioxide, ferromagnetic metals, ferromagnetic metallic alloys, and hexagonal system of Ba ferrite, Sr ferrite, Pb ferrite and Ca ferrite with the Co-adherent ferromagnetic iron oxides such as Co-adherent $\gamma.Fe_2O_3$ being preferred. The grain shape of such magnetic powders may be any of acicular, rice-grain, spherical, cubic and tabular shapes. The suitable specific surface area thereof is at least 20 $m^2/g$, particularly preferably at least 30 $m^2/g$, determined by the BET method. The suitable saturation magnetization ($\sigma$ s) of ferromagnetic powder is from $3.0\times10^4$ to $3.0\times10^5$ A/m, particularly preferably from $4.0\times10^4$ to $2.5\times10^5$ A/m. Such ferromagnetic powder may undergo surface treatment with silica and/or alumina, or an organic substance. Further, as described in JP-A-6-161032, the surface of magnetic powder may be treated with a silane coupling agent or a titanium coupling agent. In addition, the magnetic powders having inorganic or organic compound-coated surfaces disclosed in JP-A-4-259911 and JP-A-5-81652 can also be used.

In order to let a polyester support to have anticurl properites, it is subjected to heat treatment at a temperature ranging from 40° C. to lower than Tg, preferably from Tg-20° C. to lower than Tg. The heat treatment may be carried out as the temperature is held constant or decreased in the foregoing range. The heat treatment time is from 0.1 to 1,500 hours, preferably from 0.5 to 200 hours. The support may undergo the heat treatment in a form of roll or in a state of travelling web. For the purpose of improving the surface condition of the support, the roughness may be conferred on the support surface (e.g., by coating conductive inorganic fine grains of $SnO_2$ or $Sb_2O_3$). Furthermore, it is desirable to devise the prevention of a pressed mark of cut end at the core of roll by slightly raising the edge part alone by means of a roulette. The heat treatment as mentioned above may be carried out at any stage of support formation, e.g., after formation of a support film, after surface treatment, after coating of a backing layer (containing an antistatic agent, a slipping agent, etc.) or after coating of a subbing layer. However, it is preferable to carry out the heat treatment after coating an antistatic agent.

The polyester for support formation may be kneaded with an ultraviolet absorbent. Further, the light piping can be prevented by kneading the polyester with commercially available dyes or pigments for polyester, e.g., Diaresin (trade name, produced by Mitsubishi Chemical Industries, Ltd.) and Kayaset (trade name, produced by Nippon Kayaku Co., Ltd.).

Next, the film patrone in which a photographic material can be loaded is described.

The main material of a patrone usable in the present invention may be either metal or synthetic plastic.

The film may be sent out of such a patrone by rotating the spool. Further, the patrone may have such a structure that the film end is stored inside the body of the patrone and sent out of the port section into the outside by rotating the spool in the film sending-out direction, as disclosed in U.S. Pat. Nos. 4,834,306 and 5,226,613.

The photographic materials mentioned above can be advantageously applied to the lens-attached film units disclosed in JP-B-2-32615 and JP-B-U-3-39784 (the term "JP-B-U" as used herein means an "examined Japanese utility model application").

The term "lens-attached film unit" refers to the unit constituted of a plastic case, which is formed by, e.g., injection molding, equipped with a taking lens and a shutter, and an unexposed color or monochromatic photographic material which is loaded densely in a condition impervious to light in advance in the plastic case in the process of forming the body of the plastic case. After users took pictures, these units are sent to photofinishing laboratories as they are. And the exposed photographic films are taken out from those units in the photofinishing laboratories and subjected to development and print-formation.

In the present invention, it is desirable to use a processing material containing at least a base and/or a base precursor in a processing agent layer.

The base usable therein includes inorganic and organic bases. As examples of an inorganic base, mention may be made of the hydroxides, phosphates, carbonates, borates and organic acid salts of alkali metals or alkaline earth metals disclosed in JP-A-62-209448, and the acetylides of alkali metals or alkaline earth metals disclosed in JP-A-63-25208.

As examples of an organic base, mention may be made of ammonia, aliphatic or aromatic amines (e.g., primary amines, secondary amines, tertiary amines, polyamines, hydroxylamines, heterocyclic amines), amidines, bis-, tris- or tetraamidines, guanidines, water-insoluble mono-, bis-, tris- or tetraguanidines and quaternary ammonium hydroxides.

The base precursor usable therein include those of decarboxylation type, decomposition type, reaction type and complex formation type. As disclosed in EP-A-0210660 and U.S. Pat. No. 4,740,445, the method of producing a base by using the combination of a slightly water-soluble basic metal compound as a base precursor and a compound capable of undergoing the complexation reaction with the metal ion as a constituent of the basic metal compound in a water medium (referred to as a complexing compound) is favorably adopted in the present invention also. In this case, it is desirable to add a slightly water-soluble basic metal compound to the photographic material and a complexing compound to the processing material. However, it is also possible to add in the reverse of that way.

The amount of base or base precursor used is from 0.1 to 20 g/m$^2$, preferably from 1 to 10 g/m$^2$.

The binder usable in the processing layer includes the same hydrophilic polymers as employed in photographic materials.

It is desirable for the processing material to be hardened with the same hardeners as used in photographic materials.

Further, the processing material can contain a mordant for the purpose of removing the dyes which are incorporated in and, in the end, transferred thereto from the yellow filter layer and the antihalation layer of a photographic material. As the mordant used therein, polymer mordants are preferred. Suitable examples thereof include polymers containing secondary or tertiary amino groups, polymers having nitrogen-containing heterocyclic groups and polymers having cationic quaternary groups converted from those groups. It is desirable for those polymers to have molecular weight of 5,000 to 200,000, especially from 10,000 to 50,000.

The amount of mordant added is from 0.1 g/m$^2$ to 10 g/m$^2$, preferably from 0.5 g/m$^2$ to 5 g/m$^2$.

Furthermore, development stop agents or precursors thereof may be incorporated in advance in the processing material used in the present invention, and made to act at the same time as development or a while late for development.

The details of development stop agents are described in JP-A-62-190529, pages 31-32.

In addition, silver halide print-out inhibitors may be incorporated in advance in the processing material, and made to perform their function at the same time as development. Examples of such a print-out inhibitor include the halogen compounds disclosed in JP-B-54-164, JP-A-53-46020, JP-A-48-45228 and JP-B-57-8454, the 1-phenyl-5-mercaptotetrazoles disclosed in GB 1,005,144 and viologen compounds disclosed in JP-A-8-184936.

The amount of print-out inhibitor used is from $10^{-4}$ to 1 mole per mole of Ag, preferably from $10^{-3}$ to $10^{-2}$ mole per mole of Ag.

Besides the foregoing agents, physical development nuclei and silver halide solvents may be incorporated in advance in the processing material, and solubilize the silver halide in the photographic material at the same time as the development, thereby fixing the silver halide to the processing material.

As for reducing agents necessary for physical development, the reducers known in the field of photographic materials can be used. In addition, precursors of reducing agents, which themselves have no reducing properties but can demonstrate them under the action of a nucleophilic agent or heat during the processing, can also be used. The developing agent remaining in the photographic material without being used for development and diffusing therefrom into the processing material can be utilized as the reducing agent, or the reducing agent may be incorporated in advance in the processing material. In the latter case, the reducing agents incorporated in the processing material and the photographic material may be the same as or different from each other.

In a case where the developing agent incorporated is fast to diffusion, they may be used in combination with an electron transfer agent and/or a precursor thereof, if desired. The electron transfer agent and the precursor thereof can be selected from the aforementioned reducing agents and precursors respectively.

The amount of reducing agent added to the processing material is from 0.01 to 10 g/m$^2$, preferably 1/10 to 5 times the number of moles of Ag in the photographic material.

In the processing material, all of known physical development nuclei can be utilized. Examples thereof include colloidal particles of heavy metals, such as zinc, mercury, lead, cadmium, iron, chromium, nickel, tin, cobalt, copper and ruthenium; precious metals, such as palladium, platinum, gold and silver; and chalcogen compounds of those metals, such as sulfur, selenium and tellurium compounds of those metals.

It is desirable for the physical development nuclei to have a grain size of 2 to 200 nm.

The content of those physical development nuclei in the processing layer is from $10^{-3}$ mg/m$^2$ to 10 g/m$^2$.

In the processing material, known silver halide solvent can be used. Suitable examples of such a silver halide solvent include thiosulfates, sulfites, thiocyanates, the thioether compounds disclosed in JP-B-47-11386, the compounds containing 5- or 6-membered cyclic imido groups, such as uracil and hydantoin, disclosed in JP-A-8-179458, the compounds having C—S double bonds as disclosed in JP-A-53-144319, and the meso ion thiolate compounds, such as trimethyltriazolium thiolate, described in *Analytica Chimica Acta*, vol. 248, pp. 604–614 (1991). In addition, the compounds capable of fixing silver halide and stabilizing it as disclosed in JP-A-8-69097 can also be used as silver halide solvent. It is also desirable to use two or more silver halide solvents in combination.

The content of total silver halide solvents in the processing material is from 0.01 to 100 mmol/$m^2$, preferably from 0.1 to 50 mmol/$m^2$. The ratio thereof to the total silver coverage of the photographic material is from 1/20 to 20/1, preferably from 1/10 to 10/1, more preferably from 1/4 to 4/1, by mole.

In analogy with the photographic material, the processing material may have various auxiliary layers, such as aprotective layer, a subbing layer and a backing layer.

It is desirable for the processing material to have a processing layer on continuous web. The term "continuous web" as used herein means a form having a length much longer than the length of a photographic material with which the processing material deals at the time of processing, and that long enough to process a plurality of photographic materials when the processing material is used without cutting a part thereof at the time of processing. In general, the form having a length greater than its width by a factor of 5 to 10,000 is referred to as "web". The width of the processing material can be chosen arbitrarily, but it is desirable that the width thereof be greater than the width of photographic materials to be processed therewith.

Further, it is desirable for the processing material to have a form enabling a plurality of photographic materials to be processed side by side, namely a form enabling the simultaneous processing of a plurality of photographic materials arranged parallel to one another. In this case, it is desirable that the width of the processing material be greater than the value obtained by multiplying the width of each photographic material by the number of photographic materials processed at the same time.

In such a continuous web processing, it is desirable that the processing material be fed from a sending-out roll, wound onto a winding roll and then disposed of. Therein, it becomes easy in particular to dispose of large-sized photographic materials.

As mentioned above, the continuous web processing material has markedly enhanced handling suitability, compared with sheet materials.

The support used in the present processing material may have any thickness. However, it is desirable that the thickness thereof be not thick, preferably from 4 to 120 microns. Further, it is advantageous to use a processing material the support of which has a thickness of no greater than 100 microns, preferably no greater than 60 microns, especially no greater than 40 microns. In such cases, the quantity of a processing agent per unit volume can be increased, and the foregoing rolls for the processing material can be made compact.

The support has no particular restriction as to its material so far as it can stand processing temperatures. The materials generally used for the support are various kinds of paper and synthetic polymer film, such as the photographic supports described in *Shashin Kogaku no Kiso—Ginen Shashin Hen* (which means "The Fundamentals of Photographic Engineering—The silver halide photography volume), compiled by Japanese Photographic Society, published by Corona Publisher Co. (1979), pages 223–240.

Those materials may be used alone or as a combination of two or more thereof. For instance, the support may be coated or laminated with synthetic polymer, e.g., polyethylene, on one side or both sides.

Besides those supports, the supports disclosed in, e.g., JP-A-62-253159, pp. 29–31, JP-A-1-161236, pp. 14–17, JP-A-63-316848, JP-A-2-22651, JP-A-3-56955 and U.S. Pat. No. 5,001,033 can be employed.

In addition, the supports mainly constituted of syndiotactic styrene polymers can be used to advantage.

On the surface of a support as recited above, hydrophilic binder and alumina sol, semiconductive metal oxide such as tin oxide, and/or antistatic agents such as carbon black may be coated. Also, the support onto which aluminum has been evaporated in a thin layer can be used to advantage.

For development of the present photographic materials having images taken with a camera, it is desirable to adopt a method that the photographic materials are superposed on the processing material so that the light-sensitive layer faces to the processing layer and water is present therebetween in an amount ranging from one-tenth to equivalent with the amount required for achieving the maximum of swelling in all the coated layers of those materials, excluding the backing layers, and then those materials are heated for a period of 5–60 seconds at a temperature of 60–100° C.

The water used herein may be anything as far as it is generally called water. More specifically, any of distilled water, ion exchange water, city water, well water and mineral water may be used herein. For the purpose of preventing scale formation and putrefaction, it is desirable that a small amount of antiseptics be added to such water or such water be circulated and filtered with an active carbon or ion exchange resin filter.

In the present invention, the photographic material and the processing material are superposed upon each other in a condition that both or either of them is swollen with water, and then heated. As the film's state of swelling is unstable, it is important to limit the amount of water to the foregoing range for preventing localized unevenness of developed colors.

The amount of water required for the maximum of swelling can be determined as follows: A photographic or processing material having coated layers to be examined is dipped in water till it is fully swollen with water, and then the thickness thereof is measured. Based on this measurement, the maximum swelling volume is calculated, and the total weight of coated layers are deducted therefrom.

Additionally, another method of determining the swelling degree is described in *Photographic Science Engineering*, vol. 16, p. 449 (1972).

The water can be given to either the photographic material or the processing material, or both of them. The total amount of water given is from one-tenth to equivalent with the amount required for achieving the maximum of swelling in all the coated layers of those materials (excluding the backing layers).

The time to give water to the foregoing material(s) may be any stage in the period from after the exposure of the photographic material to before the heat development. Preferably, the stage of just before heat development is chosen as that time.

The amount of water specified in the present invention, which is described above, is the amount of water required at the time when the photographic material and the processing material undergo heat development in a state that they are brought into face-to-face contact with each other. Therefore, the following manner can also be included in the scope of the present invention: Water is supplied to the photographic or processing material in an amount greater than the specified amount, and then the excess water is removed by means of a squeegee or the like before these materials are brought into face-to-face contact and subjected to heat development.

Generally, the required amount of water is supplied to the photographic material and/or the processing material, or the amount of water supplied is adjusted to the required amount by the foregoing means, and then those materials are subjected to heat development in a state that they are brought into face-to-face contact with each other. However, it is also possible to hold the required amount of water between those materials by bringing the materials into face-to-face contact and then supplying water to the gap formed between them.

The water can be given in various ways. For instance, the way in which first the photographic or processing material is dipped in water and then excess water is removed with a squeegee roller can be adopted. However, it is desirable that all the required amount of water be applied at a time to the photographic or processing material. In particular, the way of jetting water is preferred, wherein is employed a water applying device analogous to a recording head of ink jet recording system. More specifically, the water-applying device comprises a plurality of water-jetting nozzles arranged at regular intervals linearly or in multiple lines along the direction crossing the travelling direction of the photographic or processing material and an actuator displacing the nozzles to the photographic or processing material on the course of travel. In addition, the way of applying water with sponge or the like is also used to advantage because the device required thereby is simple.

The temperature of water given is preferably from 30° C. to 60° C.

Examples of a way of bringing those materials into face-to-face contact include the ways disclosed in JP-A-62-253159 and JP-A-61-147244.

Examples of a heating method applicable to the heat development include the contact with a heated block or plate, a hot presser, a hot roller, hot drum, a halogen lamp heater or an infrared or far infrared lamp heater, and the passage through a high temperature atmosphere.

In the present processing, any types of heat development apparatus can be employed. Preferably, however, the apparatus disclosed in JP-A-59-75247, JP-A-59-177547, JP-A-59-181353, JP-A-60-18951, JP-A-U-62-25944, JP-A-6-130509, JP-A-6-95338, JP-A-6-95267, JP-A-8-29955 and JP-A-8-29954 can be employed.

Examples of a commercially available apparatus include Pictrostat 100, Pictrostat 200, Pictrostat 300, Pictrostat 330, Pictrostat 50, Pictrography 3000 and Pictrography 2000 (trade names, products of Fuji Photo film Co., Ltd.).

On the other hand, the present photographic material and/or processing material may take a form that both materials or either material is provided with a conductive heating unit layer as a heating means for heat development. As the heating unit therein, the heating unit disclosed in, e.g., JP-A-61-145544 can be utilized.

The present photographic material can take in image information without removing therefrom the developed silver formed therein by development and the silver halide remaining undeveloped after development, and after the removal thereof as well. In the later case, the means of removing them can be applied simultaneously with or subsequently to development.

The removal of the developed silver in the photographic material, the complexation of the silver halide or the conversion of the silver halide into a soluble form can be achieved simultaneously with development by previously incorporating a bleaching agent for oxidizing or re-halogenating silver or a silver halide solvent acting as a fixing agent in the processing material, and causing these agents to undergo reactions at the time of heat development.

On the other hand, it is possible to remove the developed silver, complex the silver halide or convert the silver halide into a soluble form by superimposing a second material containing a silver oxidizing or re-halogenating agent or a silver halide solvent upon the photographic material after the development for image formation.

It is desirable to carry out the aforementioned removal processing to an extent that the silver and silver halide residues present no obstacle to the read of image information after image formation development following the picture-taking. As the silver halide remaining undeveloped causes thick haze in a gelatin film to increase the background density, it is especially desirable to decrease the haze by the use of a complexing agent as mentioned above or to remove all or part of the silver halide remaining undeveloped from the gelatin film by solubilization thereof.

In the present invention, images are formed in the photographic material and then, based on this image information, color images are recorded on another recording material. Although the method utilizing the combination of such a photographic material as color paper and conventional projection exposure may be adopted therein, it is preferable to adopt the method in which the image information is read photoelectrically by measurement of transmission densities, transformed into digital signals and then subjected to image processing, and further the processed signals are transmitted to another recording material. Besides silver halide-utilized sensitive materials, the material to which the processed signals are transmitted may be any of sublimation type heat-sensitive recording materials, full-color direct heat-sensitive recording materials, ink jet recording materials and electrophotographic materials.

Suitable examples of an image-processing method applicable to the image formation in the present invention are described below.

The image-processing system and method disclosed in JP-A-6-139323 can be adopted, which enables faithful color reproduction of an object from a negative film, more specifically, which comprises forming an object image in a color negative, transforming the image into image data corresponding thereto by means of a scanner or the like, and outputting the same colors as those of the object from the demodulated color information.

As an image-processing method which comprises controlling the graininess or noise of a digitized image and emphasizing the image sharpness, the method disclosed in JP-A-10-243238 may be employed, wherein the weighting and subdividing processing of edges and noises is carried out on the basis of sharpness emphasized image data, smoothened image data and edge detection data, or the image-processing method disclosed in JP-A-10-243239 may be employed, wherein the edge component is determined on the basis of sharpness emphasized image data and smoothened image data, and then the weighting and subdividing processing is carried out.

In order that, in a digital color print system, the color reproduction in the final prints is corrected for variations arising from differences in, e.g., storage condition and development condition for picture-taking materials, the method disclosed in JP-A-10-255037 can be adopted, wherein the unexposed area of a picture-taking material is exposed to light via patches of at least 4 steps or 4 colors, developed and then examined for the patch densities, thereby determining the look-up table and the color conversion matrix necessary for correction and carrying out color correction of photographic images by the use of the look-up table conversion and the matrix operation.

As a method of changing the color reproduction region of image data, the method disclosed in JP-A-10-229502 can be adopted, wherein the image data are represented by color signals which form a color regarded as visually neutral when their values are well matched, and each color signal is decomposed to a colored component and a colorless component and these components are processed individually.

With respect to the image-processing method for eliminating the deterioration in quality of images taken with a camera due to aberration of the camera lens and light quantity decrease in a peripheral part of the camera lens, the method and device disclosed in Japanese Patent Application No. 9-228160 may be employed, wherein a lattice-shaped correction pattern for making correction data on image deterioration is recorded in advance on film, the image and the correction pattern are read with a film scanner or the like after picture-taking, and thereby the data for correcting the deterioration factors attributed to the camera lens are made, and further the digital image data is corrected using the correction data of the image deterioration.

As for the colors of skin and blue sky, too emphasized sharpness brings about the emphasis of graininess (noise) to create an unpleasant impression, so that it is desirable to control the degree to which the sharpness of those images is emphasized. As a method suitable for such control, the method disclosed in, e.g., Japanese Patent Application No. 9-264086 may be adopted, wherein the USM coefficient, namely the unsharp masking coefficient, is taken as the function of (B-A) and (R-A) in the unsharp masking-utilized sharpness emphasizing processing.

Further, the colors of skin, green grass and blue sky are referred to as important colors with respect to color reproduction, and require selective processing for their color reproduction. As for the brightness reproduction, it is said that the visually desirable finishing is to give a bright color to the skin image and a deep blue color to the sky image. As a method of reproducing the important colors in colors with visually desirable brightness, the method disclosed in, e.g., Japanese Patent Application No. 9-346588 may be adopted, wherein the color signal for each pixel is converted by the use of a coefficient capable of taking a small value when the corresponding hue is yellowish red, while a great value when the corresponding hue is cyan blue, such as the hue of (R-G) or (R-B).

As for the method of compressing color signals, the method disclosed in, e.g., Japanese Patent Application No. 9-270275 may be employed, wherein the color signal for each pixel is decomposed to a brightness component and a chromaticity component, and then the template having the numerical pattern best fit to the chromaticity component is selected from previously prepared templates having a plurality of hues, and thereby the hue information is coded.

In order to effect natural emphasis processing by suppressing troubles, such as color blind (lack of detail representation in the saturated color region), highlight discontinuity and collapse in high density section, and controlling the generation of data outside the defined region at the time of processing for increase in saturation, sharpness and so on, the image-processing method and device disclosed in Japanese Patent Application No. 9-338639 can be used, wherein the density data of each color among color image data are converted to exposure density data by the use of a characteristic curve and then subjected to image processing, including color emphasis, and further converted to density data by the use of a characteristic curve.

The present invention will now be illustrated in greater detail by reference to the following examples. However, the invention should not be construed as being limited to these examples.

EXAMPLE 1

In a reaction vessel was placed 930 ml of distilled water containing 0.7 g of potassium bromide and 0.74 g of gelatin having an average molecular weight of 15,000, and heated to 40° C. To this solution with vigorous stirring, 30 ml of a water solution containing 0.34 g of silver nitrate and 30 ml of a water solution containing 0.24 g of potassium bromide were added over a 20-second period. After the addition was completed, this reaction solution was kept at 40° C. for one minute, and then heated up to 75° C. Thereto, 27.0 g of gelatin was further added together with 200 ml of distilled water, and then 100 ml of a water solution containing 23.36 g of silver nitrate and 80 ml of a water solution containing 16.37 g of potassium bromide were furthermore added at increasing flow rates over a 36-minute period. Subsequently thereto, 250 ml of a water solution containing 83.2 g of silver nitrate and a water solution containing potassium iodide and potassium bromide in a ratio of 3:97 by mole (potassium bromide concentration: 26%) were added over a 60-minute period so that the flow rates thereof were increased acceleratedly and the silver potential of the reaction solution was kept at −20 mV to a saturated calomel electrode. Further, 75 ml of a water solution containing 18.7 g of silver nitrate and a 21.9% water solution of potassium bromide were added over a 10-minute period so that the silver potential of the reaction solution was kept at 20 mV to the saturated calomel electrode. After the addition was completed, the reaction solution was maintained at 75° C. for one minute, and then cooled to 40° C. The resulting reaction solution was adjusted to pH 9.0 by adding thereto 100 ml of a water solution containing 10.5 g of sodium p-iodoacetamidobenzenesulfonate monohydrate. Thereto was added 50 ml of a water solution containing 4.3 g of sodium sulfite, and then the resulting solution was kept at 40° C. for 3 minutes, followed by raising the solution temperature to 55° C. The resulting reaction solution was adjusted to pH 5.8, and then admixed with 0.8 mg of sodium benzenethiosulfinate, 0.04 mg of potassium hexachloroiridate(IV) and 5.5 g of potassium bromide, followed by standing for 1 minute at 55° C. Thereto were further added 180 ml of a water solution containing 44.3 g of silver nitrate, 160 ml of a water solution containing 34.0 g of potassium bromide and 8.9 mg of potassium hexacyanoferrate(II) over a period of 30 minutes. After cooling, the reaction solution was desalted in a conventional manner. Then, gelatin was added so that the emulsion thus obtained had a gelatin concentration of 7 weight %. Further, the emulsion obtained was adjusted to pH 6.2.

The emulsion obtained comprised hexagonal tabular grains having an average grain size of 1.29 μm, expressed in terms of sphere equivalent diameter, an average grain thickness of 0.27 μm and an average aspect ratio of 8.5 (wherein the term aspect ratio refers to the projected area diameter/thickness ratio) This emulsion was referred to as Emulsion A-1.

Emulsion A-2 and Emulsion A-3 were prepared in the same manner as Emulsion A-1, except that the amounts of silver nitrate and potassium bromide added at the initial stage of grain formation were changed to form different numbers of nuclei. The grains comprised in Emulsion A-2 were hexagonal tabular grains having an average grain size of 0.75 μm, expressed in terms of sphere equivalent diameter, an average grain thickness of 0.18 μm and an average aspect ratio of 6.9, and the grains comprised in Emulsion A-3 were hexagonal tabular grains having an average grain size of 0.52 μm, expressed in terms of sphere equivalent diameter, an average grain thickness of 0.18 μm and an average aspect ratio of 4.0. In the preparation of these emulsions, the amounts of potassium hexachloroiridate(IV) added and those of potassium hexacyanoferrate(II) added were changed so as to be inversely proportional to their respective grain volumes, while the amounts of sodium p-iodoacetamidobenzenesulfonate monohydrate added were changed so as to be proportional to their respective grain circumferences.

Further, Emulsion A-4 was prepared as follows: In a reaction vessel was placed 930 ml of distilled water containing 0.7 g of potassium bromide, 0.37 g of acid-processed gelatin and 0.37 g of gelatin having an average molecular weight of 15,000, and heated to 40° C. To this solution with vigorous stirring, 30 ml of a water solution containing 0.34 g of silver nitrate and 30 ml of a water solution containing 0.24 g of potassium bromide were added over a 20-second period. After the addition was completed, this reaction solution was kept at 40° C. for one minute, and then heated up to 75° C. Thereto, 27.0 g of gelatin having amino groups modified with trimellitic acid was further added together with 200 ml of distilled water, and then 100 ml of a water solution containing 23.36 g of silver nitrate and 80 ml of a water solution containing 16.37 g of potassium bromide were furthermore added at increasing flow rates over a 36-minute period. Subsequently thereto, 250 ml of a water solution containing 83.2 g of silver nitrate and a water solution containing potassium iodide and potassium bromide in a ratio of 3:97 by mole (potassium bromide concentration: 26%) were added over a 60-minute period so that the flow rates thereof were increased acceleratedly and the silver potential of the reaction solution was kept at −50 mV to a saturated calomel electrode. Further, 75 ml of a water solution containing 18.7 g of silver nitrate and a 21.9% water solution of potassium bromide were added over a 10-minute period so that the silver potential of the reaction solution was kept at 0 mV to the saturated calomel electrode. After the addition was completed, the reaction solution was maintained at 75° C. for one minute, and then cooled to 40° C. The resulting reaction solution was adjusted to pH 9.0 by adding thereto 100 ml of a water solution containing 10.5 g of sodium p-iodoacetamidobenzenesulfonate monohydrate. Thereto was added 50 ml of a water solution containing 4.3 g of sodium sulfite, and then the resulting solution was kept at 40° C. for 3 minutes, followed by raising the solution temperature to 55° C. The resulting reaction solution was adjusted to pH 5.8, and then admixed with 0.8 mg of sodium benzenethiosulfinate, 0.04 mg of potassium hexachloroiridate(IV) and5.5 g of potassium bromide, followed by standing for 1 minute at 55° C. Thereto were further added 180 ml of a water solution containing 44.3 g of silver nitrate, 160 ml of a water solution containing 34.0 g of potassium bromide and 8.9 mg of potassium hexacyanoferrate(II) over a period of 30 minutes. After cooling, the reaction solution was desalted in a conventional manner. Then, gelatin was added so that the emulsion thus obtained had a gelatin concentration of 7 weight %. Further, the emulsion obtained was adjusted to pH 6.2.

The emulsion obtained comprised hexagonal tabular grains having an average grain size of 1.29 μm, expressed in terms of sphere equivalent diameter, an average grain thickness of 0.13 μm and an average aspect ratio of 25.4.

Emulsion A-5 and Emulsion A-6 were prepared in the same manner as Emulsion A-4, except that the amounts of silver nitrate and potassium bromide added at the initial stage of grain formation were changed to form different numbers of nuclei. The grains comprised in Emulsion A-5 were hexagonal tabular grains having an average grain size of 0.75 μm, expressed in terms of sphere equivalent diameter, an average grain thickness of 0.11 μm and an average aspect ratio of 14.0, and the grains comprised in Emulsion A-6 were hexagonal tabular grains having an average grain size of 0.52 μm, expressed in terms of sphere equivalent diameter, an average grain thickness of 0.09 μm and an average aspect ratio of 11.3. In the preparation of these emulsions, the amounts of potassium hexachloroiridate(IV) added and those of potassium hexacyanoferrate(II) added were changed so as to be inversely proportional to their respective grain volumes, while the amounts of sodium p-iodoacetamidobenzenesulfonate monohydrate added were changed so as to be proportional to their respective grain circumferences.

To Emulsion A-1, 5.6 ml of a 1% water solution of potassium iodide was added at 40° C. The resulting emulsion was spectrally and chemically sensitized by the addition of $6.1\times10^{-4}$ mole, Compound I, potassium thiocyanate, chloroauric acid, sodium thiosulfate and mono (pentafluorophenyl)diphenylphosphine selenide. After the completion of chemical sensitization, Stabilizer S was added in an amount of $1.2\times10^{-4}$ mole. Therein, the amounts of chemical sensitizers used were each adjusted so as to chemically sensitize the emulsion to the optimum extent.

Blue-sensitive Sensitizing Dye

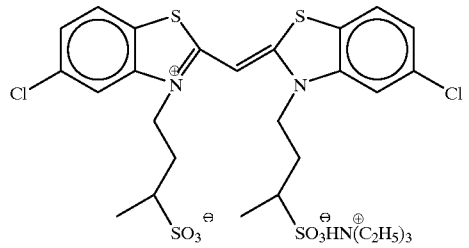

Compound I

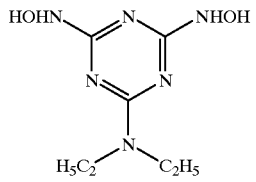

Stabilizer S

A 5:2 by mole mixture of

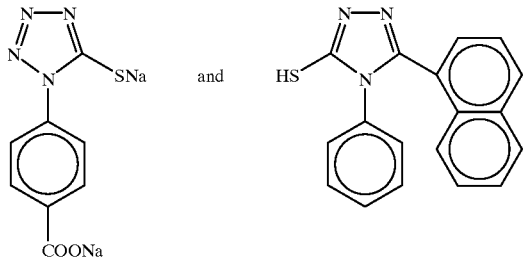

The thus prepared blue-sensitive emulsion was referred to as Emulsion A-1b.

In analogy with Emulsion A-1b, Emulsions A-2b, A-3b, A-4b, A-5b and A-6b were prepared by subjecting Emulsions A-2 to A-6 respectively to the same spectral sensitization and chemical sensitization as mentioned above. However, the amount of sensitizing dye added was changed depending on the surface area of silver halide grains in each emulsion. In addition, the amounts of chemicals used for chemical sensitization were adjusted so as to chemically sensitize each emulsion to the optimum extent.

Green-sensitive Emulsions A-1g, A-2g, A-3g, A-4g, A-5g and A-6g, and red-sensitive Emulsions A-1r, A-2r, A-3r, A-4r, A-5r and A-6r were prepared in the same manner as described above, except that the spectral sensitizing dye used was replaced by the dyes illustrated below.

Sensitizing Dye I for Green-sensitive Emulsions

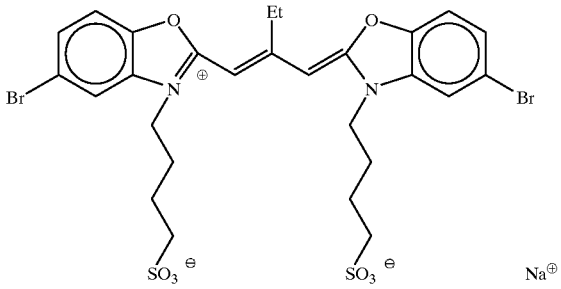

(amount added to Emulsion A-1: $5.5\times10^{-4}$ mole/mole Ag)

Sensitizing Dye II for Green-sensitive Emulsions

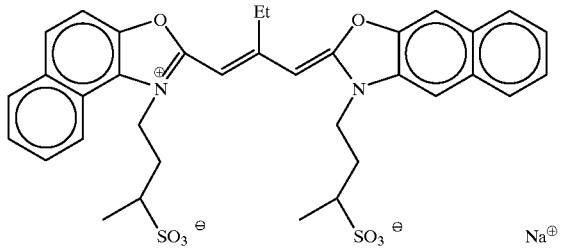

(amount added to Emulsion A-1: $1.3\times10^{-4}$ mole/mole Ag)

Sensitizing Dye III for Green-sensitive Emulsions

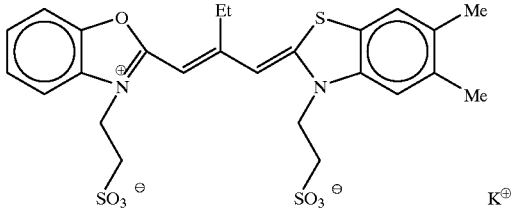

(amount added to Emulsion A-1: $4.8\times10^{-5}$ mole/mole Ag)

Sensitizing Dyes for Red-sensitive Emulsions

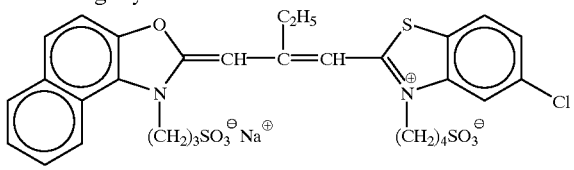

(amount added to Emulsion A-1: $2.5\times10^{-4}$ mole)

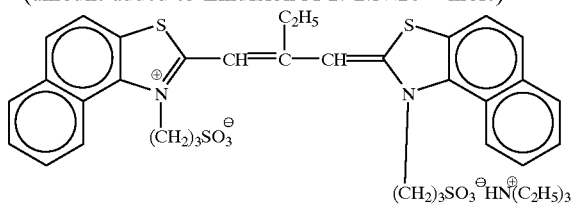

(amount added to Emulsion A-1: $6.3\times10^{-5}$ mole)

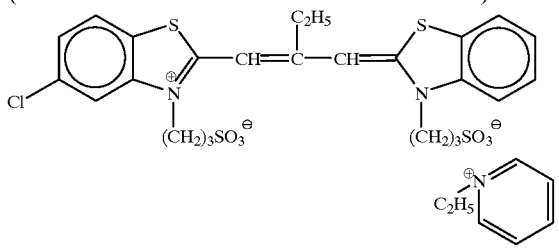

(amount added to Emulsion A-1: $3.1\times10^{-4}$ mole)

In the next place, a dispersion of zinc hydroxide used as base precursor was prepared.

A zinc hydroxide powder, the primary grains of which had a size of 0.2 $\mu$m, in an amount of 31 g was mixed with 1.6 g of carboxymethyl cellulose as a dispersant, 0.4 g of sodium polyacrylate, 8.5 g of lime-processed ossein gelatin and 158.5 ml of water, and dispersed for 1 hour with a mill using glass beads. After the dispersion was completed, the glass beads were filtered out. Thus, 188 g of the zinc hydroxide dispersion was obtained.

Further, emulsified dispersions containing couplers and incorporated developing agents were prepared as follows:

A mixture of 8.95 g of yellow Coupler (a), 7.26 g of Developing Agent (b), 1.47 g of Developing Agent (c), 0.17 g of Antifoggant (d), 0.28 g of Antifoggant (e), 18.29 g of High Boiling Organic Solvent (f) and 50.0 ml of ethyl acetate was made into a solution by heating at 60° C. This solution was mixed with 200 g of a water solution containing 18.0 g of lime-processed gelatin and 0.8 g of sodium dodecylbenzenesulfonate, and emulsified into dispersion over a 20-minute period by using a dissolver at 10,000 r.p.m. To the dispersion obtrained, distilled water was added in an amount to make the total weight 300 g, and mixed for 10 minutes at 2,000 r.p.m.

Yellow Coupler (a)

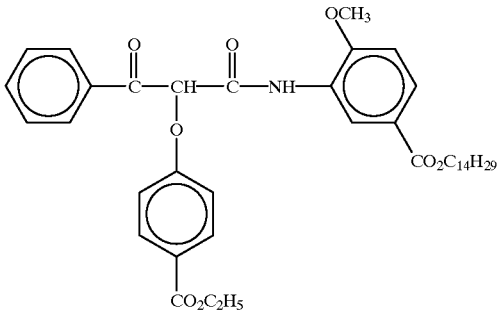

Developing Agent (b)

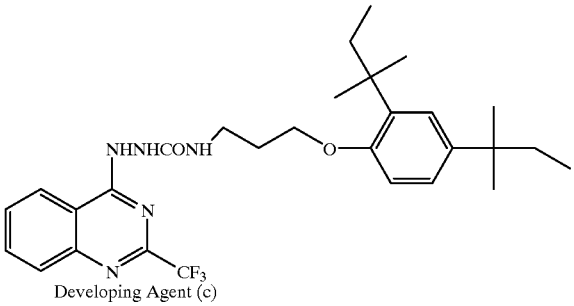

Developing Agent (c)

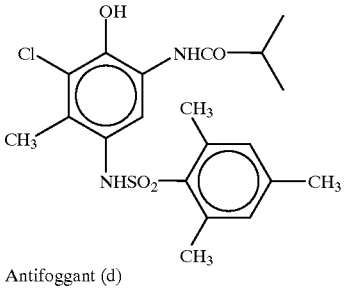

Antifoggant (d)

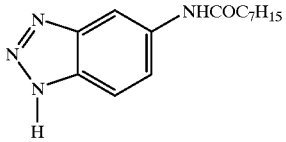

-continued

Antifoggant (e)

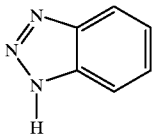

High Boiling Organic Solvent (f)

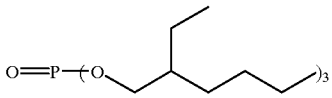

Then, a magenta coupler dispersion and a cyan coupler dispersion were prepared, too.

Specifically, a mixture of 7.65 g of magenta Coupler (g), 1.12 g of magenta Coupler (h), 8.13 g of Developing Agent (i), 1.05 g of developing Agent (c), 0.11 g of Antifoggant (d), 7.52 g of high boiling organic Solvent (j) and 38.0 ml of ethyl acetate was made into a solution by heating at 60° C. This solution was mixed with 150 g of a water solution containing 12.2 g of lime-processed gelatin and 0.8 g of sodium dodecylbenzenesulfonate, and emulsified into dispersion over a 20-minute period by using a dissolver at 10,000 r.p.m. To the dispersion obtained, distilled water was added in an amount to make the total weight 300 g, and mixed for 10 minutes at 2,000 r.p.m.

A mixture of 10.78 g of Cyan Coupler (k), 8.23 g of Developing Agent (i), 1.06 g of Developing Agent (c), 0.15 g of Antifoggant (d), 8.27 g of High Boiling Organic Solvent (j) and 38.0 ml of ethyl acetate was made into a solution by heating at 60° C. This solution was mixed with 150 g of a water solution containing 12.2 g of lime-processed gelatin and 0.8 g of sodium dodecylbenzenesulfonate, and emulsified into dispersion over a 20-minute period by using a dissolver stirrer at 10,000 r.p.m. To the dispersion obtrained, distilled water was added in an amount to make the total weight 300 g, and mixed for 10 minutes at 2,000 r.p.m.

Magenta Coupler (g)

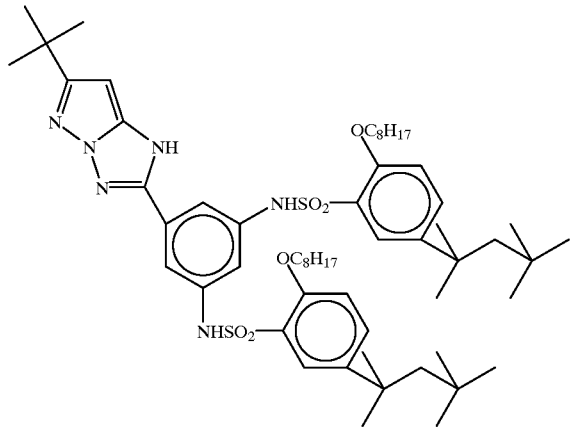

-continued
Magenta Coupler (h)
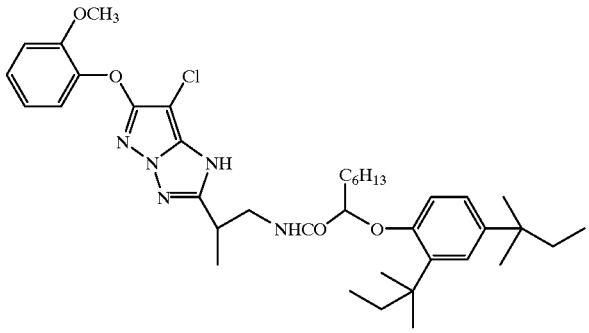
Developing Agent (i)
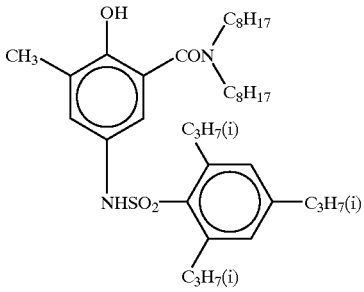
High Boiling
Organic Solvent (j)
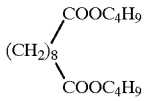
Cyan Coupler (k)
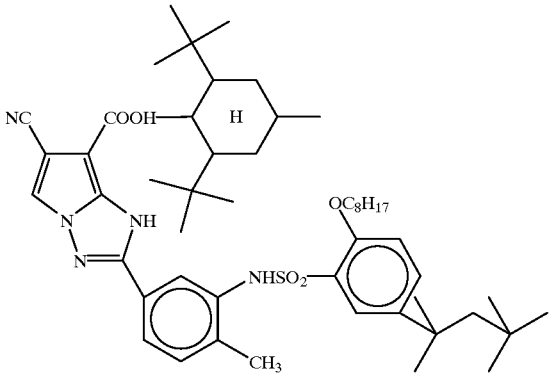
Furthermore, a dye dispersion for dyeing a filter layer and an anti-halation layer as interlayers was prepared similarly to the above.
The dye used therein and the high boiling organic solvent used for dispersing the dye are illustrated below:
Yellow Dye (1)
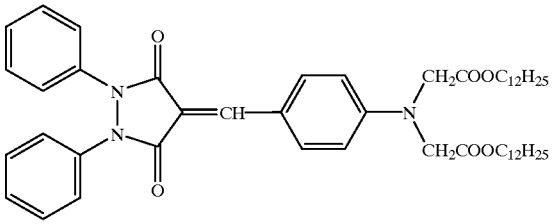

-continued

High Boiling Organic Solvent (m)

1:1 mixture of

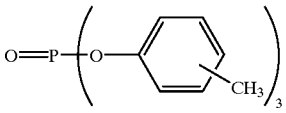

and Enpara K65 (produced by Ajinomoto Co., Inc.)

Those dispersions and the silver halide emulsions prepared above were combined so as to provide compositions set forth in Table 1, and coated on a support. Thus, multilayer color photographic materials, Sample Nos. 101 to 106, were prepared.

TABLE 1

| | Sample 101 | Sample 102 | Sample 103 | Sample 104 | Sample 105 | Sample 106 |
|---|---|---|---|---|---|---|
| Protective Layer | | | | | | |
| Lime-processed gelatin | 914 | 914 | 914 | 914 | 914 | 914 |
| Matting agent (silica) | 50 | 50 | 50 | 50 | 50 | 50 |
| Surfactant (q) | 30 | 30 | 30 | 30 | 30 | 30 |
| Surfactant (r) | 40 | 40 | 40 | 40 | 40 | 40 |
| water-soluble polymer (s) | 15 | 15 | 15 | 15 | 15 | 15 |
| Hardener (t) | 110 | 110 | 110 | 110 | 110 | 110 |
| Interlayer | | | | | | |
| Lime-processed gelatin | 461 | 461 | 461 | 461 | 461 | 461 |
| Surfactant (r) | 5 | 5 | 5 | 5 | 5 | 5 |
| Zinc hydroxide | 340 | 340 | 340 | 340 | 340 | 340 |
| Formalin scavenger (u) | 300 | 300 | 300 | 300 | 300 | 300 |
| Water-soluble polymer (s) | 15 | 15 | 15 | 15 | 15 | 15 |
| Yellow color-forming layer (high speed layer) | | | | | | |
| Lime-processed gelatin | 1750 | 1750 | 1750 | 1750 | 1750 | 1750 |
| Emulsion (based on silver coverage) | A-1b 635 | A-1b 600 | A-4b 600 | A-4b 563 | A-4b 525 | A-4b 508 |
| Yellow coupler (a) | 298 | 298 | 298 | 298 | 298 | 298 |
| Developing agent (b) | 242 | 242 | 242 | 242 | 242 | 242 |
| Developing agent (c) | 50 | 50 | 50 | 50 | 50 | 50 |
| Antifoggant (d) | 5.8 | 5.8 | 5.8 | 5.8 | 5.8 | 5.8 |
| Antifoggant (e) | 9.5 | 9.5 | 9.5 | 9.5 | 9.5 | 9.5 |
| High boiling orgsnic solvent (f) | 500 | 500 | 500 | 500 | 500 | 500 |
| Surfactant (y) | 27 | 27 | 27 | 27 | 27 | 27 |
| Water-soluble polymer (s) | 1 | 1 | 1 | 1 | 1 | 1 |
| Yellow color-forming layer (medium speed layer) | | | | | | |
| Lime-proceased gelatin | 1400 | 1400 | 1400 | 1400 | 1400 | 1400 |
| Emulsion (based on silver coverage) | A-2b 280 | A-2b 250 | A-5b 250 | A-5b 231 | A-5b 211 | A-5b 169 |
| Yellow coupler (a) | 277 | 277 | 277 | 277 | 277 | 277 |
| Developing agent (b) | 225 | 225 | 225 | 225 | 225 | 225 |
| Developing agent (c) | 46 | 46 | 46 | 46 | 46 | 46 |
| Antifoggant (d) | 5.3 | 5.3 | 5.3 | 5.3 | 5.3 | 5.3 |
| Antifoggant (e) | 8.8 | 8.8 | 8.8 | 8.8 | 8.8 | 8.8 |
| High boiling organic solvent (f) | 566 | 566 | 566 | 566 | 566 | 566 |
| Surfactant (y) | 25 | 25 | 25 | 25 | 25 | 25 |
| Water-soluble polymer (s) | 2 | 2 | 2 | 2 | 2 | 2 |
| Yellow color-forming layer (low speed layer) | | | | | | |
| Lime-processed gelatin | 1400 | 1400 | 1400 | 1400 | 1400 | 1400 |
| Emulsion (based on silver coverage) | A-3b 285 | A-3b 260 | A-6b 260 | A-6b 255 | A-6b 250 | A-6b 225 |
| Yellow coupler (a) | 277 | 277 | 277 | 277 | 277 | 277 |
| Developing agent (b) | 225 | 225 | 225 | 225 | 225 | 225 |
| Developing agent (c) | 46 | 46 | 45 | 46 | 46 | 46 |
| Antifoggant (d) | 5.3 | 5.3 | 5.3 | 5.3 | 5.3 | 5.3 |
| Antifoggant (e) | 8.8 | 8.8 | 8.8 | 8.8 | 8.8 | 8.8 |
| High boiling organic solvent (f) | 566 | 566 | 566 | 566 | 566 | 566 |
| Surfactant (y) | 25 | 25 | 25 | 25 | 25 | 25 |
| Water-soluble polymer (s) | 2 | 2 | 2 | 2 | 2 | 2 |

TABLE 1-continued

| | Sample 101 | Sample 102 | Sample 103 | Sample 104 | Sample 105 | Sample 106 |
|---|---|---|---|---|---|---|
| Interlayer (yellow filter layer) | | | | | | |
| Lime-processed gelatin | 560 | 560 | 560 | 560 | 560 | 560 |
| Surfactant (y) | 15 | 1S | 15 | 15 | 15 | 15 |
| Surfactant (r) | 24 | 24 | 24 | 24 | 24 | 24 |
| Dye (l) | 85 | 85 | 85 | 85 | 85 | 85 |
| High boiling organic solvent (n) | 85 | 85 | 85 | 85 | 85 | 85 |
| Zinc Hydroxide | 125 | 125 | 125 | 125 | 125 | 125 |
| Water-soluble polymer (s) | 15 | 15 | 15 | 15 | 15 | 15 |
| Magenta color-forming layer (high speed layer) | | | | | | |
| Lime-processed gelatin | 781 | 781 | 781 | 781 | 781 | 781 |
| Emulsion (based on silver coverage) | A-1g 1635 | A-1g 1375 | A-4g 1375 | A-4g 1111 | A-4g 892 | A-4g 750 |
| Magenta coupler (g) | 80 | 80 | 80 | 80 | 80 | 80 |
| Magenta coupler (h) | 12 | 12 | 12 | 12 | 12 | 12 |
| Developing agent (i) | 85 | 85 | 85 | 85 | 85 | 85 |
| Developing agent (c) | 11 | 11 | 11 | 11 | 11 | 11 |
| Antifoggant (d) | 1.2 | 1.2 | 1.2 | 1.2 | 1.2 | 1.2 |
| High boiling organic solvent (j) | 79 | 79 | 79 | 79 | 79 | 79 |
| Surfactant (y) | 8 | 8 | 8 | 8 | 8 | 8 |
| Water-soluble polymer (s) | 8 | 8 | 8 | 8 | 8 | 8 |
| Magenta color-forming layer (medium speed layer) | | | | | | |
| Lime-processed gelatin | 659 | 659 | 659 | 659 | 659 | 659 |
| Emulsion (based on silver coverage) | A-2g 935 | A-2g 800 | A-5g 800 | A-5g 735 | A-5g 669 | A-5g 446 |
| Magenta coupler (g) | 103 | 103 | 103 | 103 | 103 | 103 |
| Magents coupler (h) | 15 | 15 | 15 | 15 | 15 | 15 |
| Developing agent (i) | 110 | 110 | 100 | 110 | 110 | 110 |
| Developing agent (c) | 14 | 14 | 14 | 14 | 14 | 14 |
| Antifoggant (d) | 1.5 | 1.5 | 1.5 | 1.5 | 1.5 | 1.5 |
| High boiling organic solvent (j) | 102 | 102 | 102 | 102 | 102 | 102 |
| Surfactant (y) | 11 | 11 | 11 | 11 | 11 | 11 |
| Water-soluble polymer (s) | 14 | 14 | 14 | 14 | 14 | 14 |
| Magenta color-forming layer (low speed layer) | | | | | | |
| Lime-processed gelatin | 711 | 711 | 711 | 711 | 711 | 711 |
| Emulsion (based on silver coverage) | A-3g 550 | A-3g 550 | A-6g 550 | A-6g 393 | A-6g 235 | A-6g 235 |
| Magenta coupler (g) | 274 | 274 | 274 | 274 | 274 | 274 |
| Magenta coupler (h) | 40 | 40 | 40 | 40 | 40 | 40 |
| Developing agent (i) | 291 | 291 | 291 | 291 | 291 | 291 |
| Developing agent (c) | 38 | 38 | 38 | 38 | 38 | 38 |
| Antifoggant (d) | 3.9 | 3.9 | 3.9 | 3.9 | 3.9 | 3.9 |
| High boiling organic solvent (j) | 269 | 269 | 269 | 269 | 269 | 269 |
| Surfactant (y) | 29 | 29 | 29 | 29 | 29 | 29 |
| Water-soluble polymer (s) | 14 | 14 | 14 | 14 | 14 | 14 |
| Interlayer (magenta filter layer) | | | | | | |
| Lime-processed gelatin | 850 | 850 | 850 | 850 | 850 | 850 |
| Surfactant (y) | 15 | 15 | 15 | 15 | 15 | 15 |
| Surfactant (r) | 24 | 24 | 24 | 24 | 24 | 24 |
| Dye (n) | 200 | 200 | 200 | 200 | 200 | 200 |
| High boiling organic solvent (o) | 200 | 200 | 200 | 200 | 200 | 200 |
| Formalin scavenger (u) | 300 | 300 | 300 | 300 | 300 | 300 |
| Zinc hydroxide | 2028 | 2028 | 2028 | 2028 | 2028 | 2028 |
| Water-soluble polymer (s) | 15 | 15 | 15 | 15 | 15 | 15 |
| Cyan color-forming layer (high speed layer) | | | | | | |
| Lime-processed gelatin | 842 | 842 | 842 | 842 | 842 | 842 |
| Emulsion (based on silver coverage) | A-1r 1635 | A-1r 1375 | A-4r 1375 | A-4r 1111 | A-4r 1040 | A-4r 1010 |
| Cyan coupler (k) | 64 | 64 | 64 | 64 | 64 | 64 |
| Developing agent (i) | 75 | 75 | 75 | 75 | 75 | 75 |

TABLE 1-continued

| | Sample 101 | Sample 102 | Sample 103 | Sample 104 | Sample 105 | Sample 106 |
|---|---|---|---|---|---|---|
| Developing agent (c) | 6 | 6 | 6 | 6 | 6 | 6 |
| Antifoggant (d) | 0.9 | 0.9 | 0.9 | 0.9 | 0.9 | 0.9 |
| High boiling organic solvent (j) | 49 | 49 | 49 | 49 | 49 | 49 |
| Surfactant (y) | 5 | 5 | 8 | 5 | 5 | 5 |
| Water-soluble polymer (s) | 18 | 18 | 18 | 18 | 18 | 18 |
| Cyan color-forming layer (medium speed layer) | | | | | | |
| Lime-processed gelatin | 475 | 475 | 475 | 475 | 475 | 475 |
| Emulsion (based on silver coverage) | A-2r 1135 | A-2r 1000 | A-5r 1000 | A-5r 806 | A-5r 602 | A-5r 397 |
| Cyan coupler (k) | 134 | 134 | 134 | 134 | 134 | 134 |
| Developing agent (i) | 102 | 102 | 102 | 102 | 102 | 102 |
| Developing agent (c) | 13 | 13 | 13 | 13 | 13 | 13 |
| Antifoggant (d) | 1.9 | 1.9 | 1.9 | 1.9 | 1.9 | 1.9 |
| High boiling organic solvent (j) | 103 | 103 | 103 | 103 | 103 | 103 |
| Surfactant (y) | 10 | 10 | 10 | 10 | 10 | 10 |
| Water-soluble polymer (s) | 15 | 15 | 15 | 15 | 15 | 15 |
| Cyan color-forming layer (low speed layer) | | | | | | |
| Lime-processed gelatin | 825 | 825 | 825 | 825 | 825 | 825 |
| Emulsion (based on silver coverage) | A-3r 720 | A-3r 705 | A-6r 705 | A-6r 576 | A-6r 447 | A-6r 298 |
| Cyan coupler (k) | 234 | 234 | 234 | 234 | 234 | 234 |
| Developing agent (i) | 179 | 179 | 179 | 179 | 179 | 179 |
| Developing agent (c) | 23 | 23 | 23 | 23 | 23 | 23 |
| Antifoggant (d) | 3.3 | 3.3 | 3.3 | 3.3 | 3.3 | 3.3 |
| High boiling organic solvent (j) | 179 | 179 | 179 | 179 | 179 | 179 |
| Surfactant (y) | 17 | 17 | 17 | 17 | 17 | 17 |
| Water-soluble polymer (s) | 10 | 10 | 10 | 10 | 10 | 10 |
| Anti-halation layer | | | | | | |
| Lime-processed gelatin | 440 | 440 | 440 | 440 | 440 | 440 |
| Surfactant (y) | 14 | 14 | 14 | 14 | 14 | 14 |
| Dye (p) | 260 | 260 | 260 | 260 | 260 | 260 |
| High boiling organic solvent (o) | 260 | 260 | 260 | 260 | 260 | 260 |
| Water-doluble polymer (s) | 15 | 15 | 15 | 15 | 15 | 15 |
| | Transparent PET base (96 μm) | | | | | |

Magenta Dye (n)

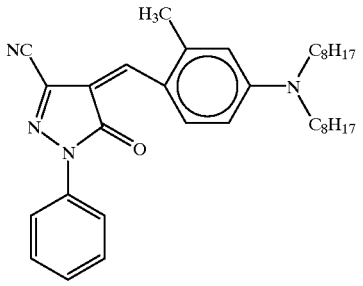

High Boiling Organic Solvent (o)

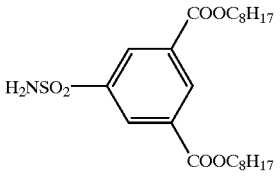

-continued

Cyan Dye (p)

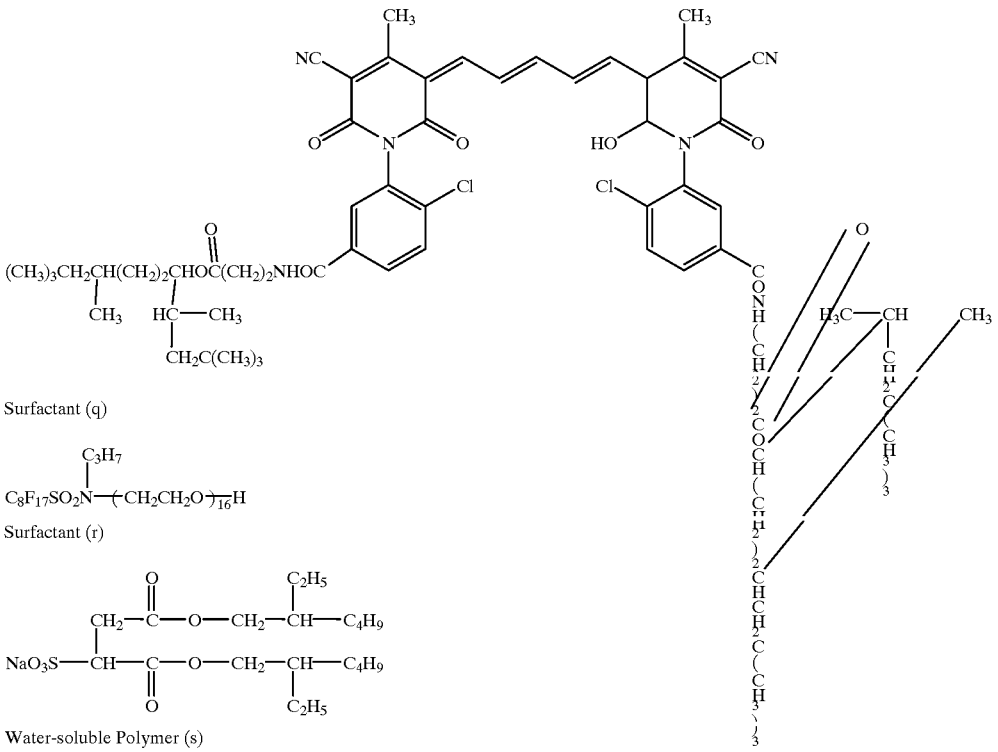

Surfactant (q)

Surfactant (r)

Water-soluble Polymer (s)

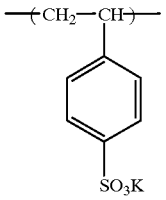

Hardener (t)

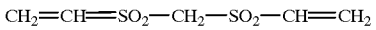

Formalin Scavenger (u)

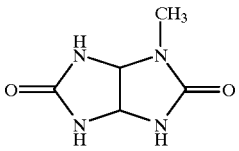

Furthermore, processing materials P-1 and P-2 as shown in Table 2 and 3 respectively were prepared.

TABLE 2

Constitution of Processing Material P-1

| Layer structure | Ingredients used | Amount added ($mg/m^2$) |
|---|---|---|
| Fourth layer (Protective layer) | Acid-processed gelatin | 220 |
| | Water-soluble polymer (v) | 60 |
| | Water-soluble polymer (w) | 200 |
| | Additive (x) | 80 |
| | Potassium nitrate | 16 |

TABLE 2-continued

Constitution of Processing Material P-1

| Layer structure | Ingredients used | Amount added ($mg/m^2$) |
|---|---|---|
| | Matting agent (z) | 10 |
| | Surfactant (r) | 7 |
| | Surfactant (aa) | 7 |
| | Surfactant (ab) | 10 |
| Third layer (Interlayer) | Lime-processed gelatin | 240 |
| | Water-soluble polymer (w) | 24 |
| | Hardener (ac) | 180 |
| | Surfactant (y) | 9 |

TABLE 2-continued

Constitution of Processing Material P-1

| Layer structure | Ingredients used | Amount added (mg/m$^2$) |
|---|---|---|
| Second layer (Base producing layer) | Lime-processed gelatin | 2100 |
| | Water-soluble polymer (w) | 360 |
| | Water-soluble polymer (ad) | 700 |
| | Water-soluble polymer (ae) | 600 |
| | High boiling organic solvent (af) | 2120 |
| | Additive (ag) | 20 |
| | Guanidine picolinate | 2613 |
| | Potassium quinolinate | 225 |
| | Sodium quinolinate | 192 |
| | Surfactant (y) | 24 |
| First layer (Subbing layer) | Lime-processed gelatin | 247 |
| | Water-soluble polymer (v) | 12 |
| | Surfactant (r) | 14 |
| | Hardener (ac) | 178 |
| | Transparent support (63 μm) | |

TABLE 3

Constitution of Processing Material P-2

| Layer structure | Ingredients used | Amount added (mg/m$^2$) |
|---|---|---|
| Fifth layer (Protective layer) | Acid-processed gelatin | 490 |
| | Matting agent (z) | 10 |
| Fourth layer (Interlayer) | Lime-processed gelatin | 240 |
| | Hardener (ac) | 250 |
| Third layer (Solvent layer) | Lime-processed gelatin | 4890 |
| | Silver halide solvent (ah) | 5770 |
| Second layer (Interlayer) | Lime-processed gelatin | 370 |
| | Hardener (ac) | 500 |
| First layer (Subbing layer) | Lime-processed gelatin | 247 |
| | Water-soluble polymer (v) | 12 |
| | Surfactant (r) | 14 |
| | Hardener (ac) | 178 |
| | Transparent support (63 μm) | |

Water-soluble Polymer (v) : κ - Carrageenan
Water-soluble Polymer (w) : Sumikagel L-5H (trade name, a product of Sumitomo Chemical Co., Ltd.)

Additive (x)

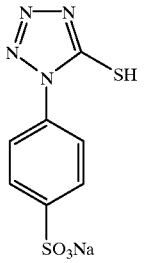

Surfactant (y)

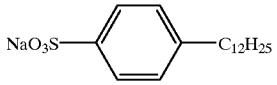

Matting Agent (z)
SYLOID D79 (trade name, a product of Fuji Davison Co.)

Surfactant (aa)

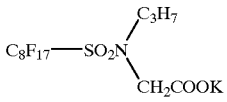

Surfactant (ab)

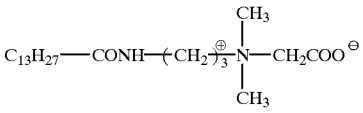

Hardener (ac)

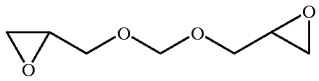

Water-soluble Polymer (ad)
Dextrane (molecular weight: 70,000)
Water-soluble Polymer (ae)
MP polymer MP102 (product of Kuraray Co., Ltd.)
High Boiling Solvent (af)
Enpara 40 (produced by Ajinomoto Co., Inc.)

Additive (ag)

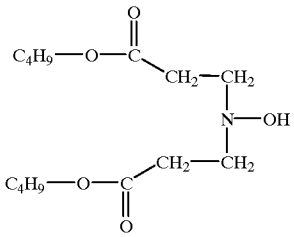

Silver Halide Solvent (ah)

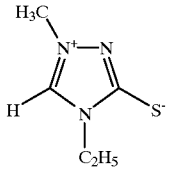

Sample pieces were cut out from the foregoing photographic material samples, and exposed to light of 200 lux via an optical wedge for 1/100 second under the same condition as adopted for determination of characteristic photographic speed in the present invention. Separate sample pieces cut out were subjected to step exposure for measurement of RMS granularity.

After exposure, these sample pieces were subjected to color development by the use of a standard developer, CN-16, made by Fuji Photo film Co., Ltd. for color negative film. Therein, the color development was performed under two different conditions. Specifically, one is standard processing at 38° C. for 3 minutes and 15 seconds and the other is high temperature processing at 52° C. for 50 seconds. The transmission densities of the sample films thus processed were measured, and therefrom the characteristic photographic speed and RMS granularity of each sample film were determined.

On the other hand, 40° C. water was applied to the exposed sample surface at a coverage of 15 ml/m$^2$. These water-applied sample pieces were brought into face-to-face contact with the processing material P-1 and then underwent 17-second heat development at 86° C. by means of a heat drum. The sample pieces thus developed were separated from P-1, coated with 10 cc/m$^2$ of water on the surface side, and further brought into face-to-face contact with the processing material P-2, followed by 30-second heating at 50° C.

Similarly to the sample pieces which had undergone the aforementioned liquid development, the transmission densities of colors developed in the sample pieces by the foregoing heat development were measured, and therefrom the characteristic photographic speed and RMS granularity of each sample were determined.

Further, the multi-layer color photographic materials prepared above, Sample Nos. 101 to 106, were each tested for deterioration in quality upon storage before exposure.

In order to examine the deterioration of photographic material samples during the storage as products, the photographic materials stored for 6 months in the Osaka branch of Fuji Photo Film Co., Ltd. were prepared as samples. On the other hand, the photographic materials produced were allowed to stand for 1 week at 25° C., and then placed in a box enclosed with thick lead plate and stored in a freezer. The thus stored samples were adopted as standard control samples for knowing the photographic properties which the photographic materials had just after production.

These control samples were also tested for photographic properties in the same manner as mentioned above. The increments in fog of the samples after 6-month storage, compared with their respective control samples, and the RMS granularity after 6-month storage of each sample were determined, which were taken as a measure of deterioration in quality upon storage before exposure.

The results obtained are shown in Table 4-1, Table 4-2 and Table 4-3.

TABLE 4-1

Development with CN-16 at 38° C. for 3'15"

| | total silver coverage (g/m$^2$) | Characteristic photographic speed | Value of present specific ratio | RMS granularity | | Increment in fog after storage | RMS granularity after storage | |
|---|---|---|---|---|---|---|---|---|
| Sample 101 | 7.81 | 1430 | 0.207 | R | 0.032 | 0.21 | R | 0.045 |
| | | | | G | 0.027 | 0.18 | G | 0.039 |
| | | | | B | 0.029 | 0.22 | B | 0.042 |
| Sample 102 | 6.92 | 1136 | 0.205 | R | 0.038 | 0.15 | R | 0.043 |
| | | | | G | 0.033 | 0.13 | G | 0.038 |
| | | | | B | 0.035 | 0.16 | B | 0.040 |
| Sample 103 | 6.92 | 1375 | 0.187 | R | 0.035 | 0.11 | R | 0.038 |
| | | | | G | 0.030 | 0.09 | G | 0.032 |
| | | | | B | 0.032 | 0.12 | B | 0.035 |
| Sample 104 | 5.78 | 1280 | 0.162 | R | 0.037 | 0.08 | R | 0.039 |
| | | | | G | 0.033 | 0.07 | G | 0.035 |
| | | | | B | 0.036 | 0.07 | B | 0.039 |
| Sample 105 | 4.87 | 1189 | 0.141 | R | 0.039 | 0.05 | R | 0.041 |
| | | | | G | 0.036 | 0.06 | G | 0.038 |
| | | | | B | 0.038 | 0.07 | B | 0.040 |
| Sample 106 | 4.04 | 1085 | 0.123 | R | 0.042 | 0.05 | R | 0.044 |
| | | | | G | 0.039 | 0.05 | G | 0.040 |
| | | | | G | 0.041 | 0.06 | B | 0.043 |

The data in the area surrounded by double lines are within the scope of the present invention.

TABLE 4-2

Development with CN-16 at 52° C. for 50"

| | Total silver coverage (g/m$^2$) | Characteristic photographic speed | Value of present specific ratio | RMS granularity | Increment in fog after storage | RMS granularity after storage |
|---|---|---|---|---|---|---|
| Sample 101 | 7.81 | 1568 | 0.197 | R 0.029 | 0.22 | R 0.042 |
| | | | | G 0.024 | 0.19 | G 0.036 |
| | | | | B 0.026 | 0.23 | B 0.039 |
| Sample 102 | 6.92 | 1366 | 0.187 | R 0.033 | 0.14 | R 0.036 |
| | | | | G 0.028 | 0.12 | G 0.031 |
| | | | | B 0.030 | 0.15 | B 0.034 |
| Sample 103 | 6.92 | 1570 | 0.175 | R 0.030 | 0.13 | R 0.032 |
| | | | | G 0.025 | 0.10 | G 0.027 |
| | | | | B 0.026 | 0.11 | B 0.028 |
| Sample 104 | 5.78 | 1404 | 0.154 | R 0.032 | 0.09 | R 0.034 |
| | | | | G 0.027 | 0.08 | G 0.029 |
| | | | | B 0.029 | 0.08 | B 0.031 |
| Sample 105 | 4.87 | 1304 | 0.135 | R 0.033 | 0.06 | R 0.035 |
| | | | | G 0.029 | 0.06 | G 0.031 |
| | | | | B 0.030 | 0.07 | B 0.032 |
| Sample 106 | 4.04 | 1190 | 0.117 | R 0.035 | 0.06 | R 0.037 |
| | | | | G 0.032 | 0.06 | G 0.034 |
| | | | | G 0.034 | 0.07 | B 0.036 |

The data in the area surrounded by double lines are within the scope of the present invention.

TABLE 4-3

Heat Development at 86° C. for 17"

| | Total silver coverage ($g/m^2$) | Characteristic photographic speed | Value of present specific ratio | RMS granularity | Increment in fog after storage | RMS granularity after storage |
|---|---|---|---|---|---|---|
| Sample 101 | 7.81 | 1381 | 0.210 | R 0.027<br>G 0.026<br>B 0.041 | 0.24<br>0.22<br>0.25 | R 0.039<br>G 0.038<br>B 0.055 |
| Sample 102 | 6.92 | 1480 | 0.180 | R 0.028<br>G 0.027<br>B 0.042 | 0.16<br>0.14<br>0.16 | R 0.033<br>G 0.032<br>B 0.047 |
| Sample 103 | 6.92 | 1585 | 0.174 | R 0.024<br>G 0.023<br>B 0.038 | 0.13<br>0.12<br>0.13 | R 0.027<br>G 0.026<br>B 0.042 |
| Sample 104 | 5.78 | 1594 | 0.145 | R 0.024<br>G 0.022<br>B 0.037 | 0.10<br>0.09<br>0.09 | R 0.027<br>G 0.025<br>B 0.040 |
| Sample 105 | 4.87 | 1671 | 0.119 | R 0.023<br>G 0.022<br>B 0.037 | 0.07<br>0.06<br>0.08 | R 0.026<br>G 0.024<br>B 0.039 |
| Sample 106 | 4.04 | 1720 | 0.097 | R 0.023<br>G 0.021<br>G 0.036 | 0.07<br>0.06<br>0.07 | R 0.025<br>G 0.023<br>B 0.038 |

The data in the area surrounded by double lines are within cope of the present invention.

The results shown in the above tables show remarkable effects of the present invention. More specifically, in the case of liquid development with CN-16 under the standard condition, the reduction in total silver coverage of the photographic material enabled the control of deterioration in quality upon storage before exposure, but lowered the sensitivity and made the RMS granularity worse even just after the time when the photographic materials were produced. However, when the development was performed in a short time at a high temperature of 52° C. though the same developer was used, the lowering of sensitivity and the deterioration of granularity were significantly reduced in extent. On the other hand, when the present photographic materials underwent the heat development using the processing material P-1 at a high temperature of 86° C., their sensitivities and RMS granularities were definitely improved as the stability of photographic properties was retained upon storage before exposure. As is apparent from the results mentioned above, the multi-layer color photographic materials produced so as to have the total silver coverage within the range specified by the present invention had high sensitivity, satisfactory granularity and excellent storage stability before exposure.

By subjecting the present photographic materials to high temperature development, the conventional trade-off relation of silver coverage against sensitivity and granularity can be improved. This effect was more remarkable in the heat development system of developing agent-incorporated photographic materials. Such an effect is new and cannot be expected from known conventional arts.

EXAMPLE 2

Multi-layer color photographic materials were produced in the same manner as in Example 1, except that the transparent PET film support was replaced by a support prepared by the method described below, and subjected to the same tests as in Example 1.

Therein, each photographic material was loaded in a cartridge, and underwent the tests. Similarly to Example 1, satisfactory test results were obtained, and the present effects were confirmed.

The support was prepared as follows:

Polyethylene-2,6-naphthalate polymer in an amount of 100 parts by weight, and 2 parts by weight of an ultraviolet absorbent, Tinuvin P.32 (produced by Ciba-Geigy A.G.) were dried, and molten at 300° C. The molten matter was extruded from T-form die, and subjected to 3.3-fold longitudinal stretching at 140° C. and then to 3.3-fold traverse stretching at 130° C., and further to 6-second thermal fixation at 250° C., thereby preparing 92 μm-thick PEN film.

Additionally, in the PEN film were added in advance blue dyes, magenta dyes and yellow dyes (specifically I-1, I-4, I-6, I-24, I-26, I-27 and II-5 disclosed in Kokai Giho No. 94-6023) in the amounts to provide the yellow density of 0.01, the magenta density of 0.08 and the cyandensity of 0.09. Further, thermal hysteresis was given to the PEN film by winding the film onto a stainless roll having a diameter of 20 cm, and heating it at 113° C. for 3 hours, thereby making the film support hard to curl.

Furthermore, both surfaces of the film support were subjected to corona discharge, UV discharge and glow discharge treatments. On the high-temperature side at the time of stretching treatment, the discharge-treated support was coated with a subbing solution containing gelatin (0.1 $g/m^2$), sodium α-sulfodi-2-ethylhexylsuccinate (0.01 $g/m^2$), salicylic acid (0.025 $g/m^2$), PQ-1 (0.005 $g/m^2$) and PQ-2 (0.006 $g/m^2$) at a coverage of 10 $ml/m^2$ by means of a bar coater. The drying was performed by 6-minute heating at 115° C. (the rollers installed in the drying zone and the carrying devices were all kept at 115° C.).

After providing the subbing layer, the other side of the support was coated with an antistatic layer, a magnetic recording layer and a slipping layer having the following compositions respectively as backing layers.

Composition of Antistatic Layer:

A fine grain dispersion of tin oxide-antimony oxide complex having an average grain size of 0.005 μm and specific resistance of 5 Ω·cm (grain size of secondary condensates: about 0.08 μm; 0.027 $g/m^2$), gelatin (0.03 $g/m^2$), $(CH_2{=}CHSO_2CH_2CH_2NHCO)_2CH_2$ (0.02 $g/m^2$), polyoxyethylene(polymerization degree: 10)-p-nonylphenol (0.005 $g/m^2$), PQ-3 (0.008 $g/m^2$) and resorcin were coated.

Composition of Magnetic Recording Layer:

A dispersion of 0.06 $g/m^2$ of Co-γ-iron oxide (specific surface area: 43 $m^2/g$; length: 0.14 μm; breadth: 0.03 μm; saturation magnetization: 89 emu/g; $Fe^{+2}/Fe^{+3}$=6/94; the surface thereof was treated with aluminum oxide and silicon oxide in a proportion of 2 weight % to the iron oxide) coated with 3-polyoxyethylene(polymerization degree: 15)-propyloxytrimethoxysilane (15 weight %), 1.15 $g/m^2$ of diacetyl cellulose and hardeners, PQ-4 (0.075 $g/m^2$) and PQ-5 (0.004 $g/m^2$) in a solvent constituted of acetone, methyl ethyl ketone, cyclohexanone and dibutyl phthalate (the dispersion of iron oxide was carried out by means of an open kneader and a sand mill) was coated with bar coater to form a 1.2 μm-thick magnetic recording layer. To the dispersion were added in advance $C_6H_{13}CH(OH)C_{10}H_{20}COOC_{40}H_{81}$ as a lubricant (50 $g/m^2$), 5 $mg/^2$ of silica grains (average grain size: 1.0 μm) as a matting agent and 15 $mg/m^2$ of aluminum oxide (ERC-DBM, a product of Reynolds Metal Inc., average grain size: 0.44 μm) as an abrasive. The drying of the coated layer was performed by 6-minute heating at 115° C. (the rollers installed in the drying zone and the carrying devices were all kept at 115° C.). The increment in color density $D^B$ of the magnetic recording layer under X-light (blue filter) was about 0.1, and the saturated magnetic moment of the magnetic recording layer was 4.2 emu/g, the coercive force thereof was $7.3\times10^4$ A/m and the squareness ratio thereof was 65%.

Composition of Slipping Layer:

A mixture of hydroxyethyl cellulose (25 mg/m$^2$), PQ-6 (7.5 mg/m$^2$), PQ-7 (1.5 mg/m$^2$) and polydimethylsiloxane (B-3)(1.5 mg/m$^2$) was dissolved at 105° C. in 1:1 mixture of xylene and propylene glycol monomethyl ether, poured into 10-fold amount of propylene monomethyl ether having an ordinary temperature, made into a dispersion in an acetone medium (average particle size: 0.01 μm), and then coated. The drying of the coated layer was performed by 6-minute heating at 115° C. (the rollers installed in the drying zone and the carrying devices were all kept at 115° C.).

The slipping layer thus prepared had a kinetic friction coefficient of 0.10 (stainless ball of 5 mmΦ, load 100 g, speed 6 cm/min) and a static friction coefficient of 0.09 (Clip method). In addition, the kinetic friction coefficient between the slipping layer and the emulsion layer was 0.18. Therefore, it can be said that the slippability of this layer was excellent.

PQ-1

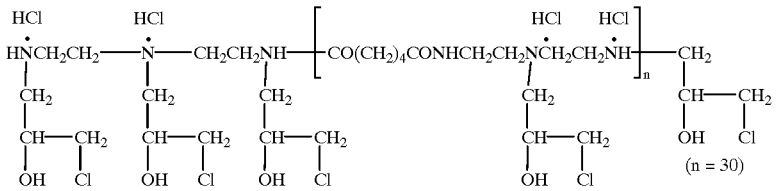

PQ-2

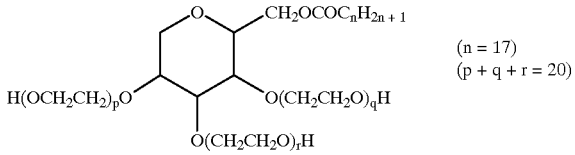

PQ-3

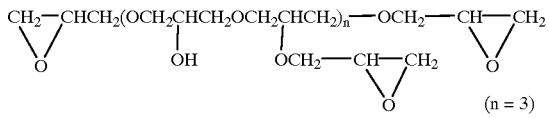

PQ-4

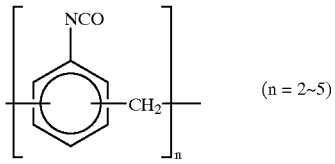

$(CH_3O)_3SiCH_2CH_2CH_2O(CH_2CH_2O)_nCH_3$ (n≈7.3) PQ-5

$C_{50}H_{101}(CH_2CH_2O)_nH$ (n≈16) PQ-6

PQ-7

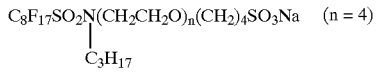

In accordance with the present invention, high sensitivity, excellent graininess and high storage stability can be ensured in color photographic materials for picture-taking use, and further, color images of high quality can be formed by adopting simple, rapid, environmental load-reduced processing.

What is claimed is:

1. A silver halide color photographic material which comprises a support coated with at least three light-sensitive layers comprising blue-sensitive, green-sensitive and red-sensitive silver halide emulsions respectively; and a developing agent and a compound forming a dye by coupling reaction with the oxidation product of the developing agent, wherein said photographic material having a characteristic speed of at least 800 and the total coverage of at most 7.0 g/m$^2$; said photographic material having suitability for high-temperature development processing carried out at about 70° C. or above, and satisfying the following relation between the total silver coverage (X) and the characteristic speed (Y):

$$(X)/(Y)^{1/2} \leqq 0.185.$$

2. A silver halide color photographic material as described in claim 1, wherein the characteristic speed is at least a 1,000, the total silver coverage is at most 6.5 g/m$^2$.

3. A silver halide color photographic material as described in claim 1, wherein at least one of the light-sensitive silver halide emulsions comprises silver halide grains at least 50%, on a projected area basis, of which are tabular grains having a thickness of 0.2 μm or below and an aspect ratio of from 2 to 80, wherein the aspect ratio is the value obtained by dividing the projected grain area diameter by the grain thickness.

4. A silver halide color photographic material as described in claim 1, wherein images are formed when the photographic material is exposed and then developed by superimposing thereon a processing material comprising a support coated with a base and/or base precursor-containing processing layer in a condition that the photographic material and the processing material face each other and water lies between them in an amount ranging from one-tenth to equivalent with the amount required for achieving the maximum of swelling in all the coated layers of those materials and then applying heat to those materials.

5. A silver halide color photographic material as described in claim 1, wherein the developing agent is a compound represented by the following formula (I), (II), (III) or (IV):

Formula (I)

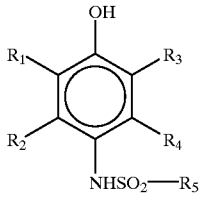

Formula (II)

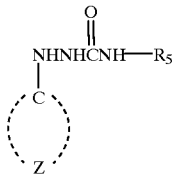

Formula (III)

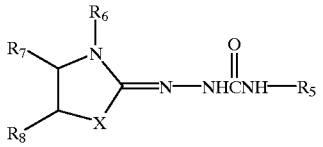

Formula (IV)

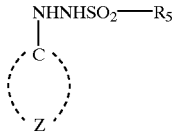

wherein $R_1$, $R_2$, $R_3$ and $R_4$ each represent a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents an alkyl group, an aryl group or a heterocyclic group; Z represents atoms completing an aromatic hydrocarbon or heterocyclic ring, wherein when the ring completed is a substituted benzene ring the total Hammett's σ values of substituent groups on the benzene ring is at least one; $R_6$ represents an alkyl group; X represents an oxygen atom, a sulfur atom, a selenium atom or a tertiary nitrogen atom to which an alkyl or aryl group is attached; and $R_7$ and $R_8$ each represent a hydrogen atom or a substituent group, or $R_7$ and $R_8$ combine with each other to form a double bond or a ring; provided that at least one ballast group having at least 8 carbon atoms is present in each of the formulae (I) to (IV) to confer solubility in oils upon the compound.

6. A method of forming color images, comprising the following steps sequentially;

a step of exposing imagewise a silver halide photographic material, which comprises a support coated with at least three light-sensitive layers comprising blue-sensitive, green-sensitive and red-sensitive silver halide emulsions respectively; said photographic material having a characteristic speed of at least 800 and the total coverage of at most 7.0 g/m$^2$, and satisfying the following relation between the total silver coverage (X) and the characteristic speed (Y):

$$(X)/(Y)^{1/2} \leqq 0.185,$$

a step of superimposing the photographic material upon a processing material which comprises a support coated with a base and/or base precursor-containing processing layer in a condition that the processing material and the photographic material face each other and water lies between them in an amount ranging from one-tenth to equivalent with the amount required for achieving the maximum of swelling in all the coated layers of those materials, and a step of heating the superimposed materials for a period of from 5 to 60 seconds at a temperature of from 60° C. to 100° C.

7. A silver halide color photographic material, comprised of: a support coated with at least three light-sensitive layers comprising blue-sensitive, green-sensitive and red-sensitive silver halide emulsions respectively; said photographic material having a characteristic speed of at least 800 and the total coverage of at most 7.0 g/m$^2$, and satisfying the following relation between the total silver coverage (X) and the characteristic speed (Y):

$$(X)/(Y)^{1/2} \leqq 0.185,$$

wherein images are formed when the photographic material is exposed and then developed by superimposing thereon a processing material comprising a support coated with a base and/or base precursor-containing processing layer in a condition that the photographic material and the processing material face each other and the water lies between them in an amount ranging from one-tenth to equivalent with the amount required for achieving the maximum of swelling in all the coated layers of those materials and then applying heat to those materials.

* * * * *